US011735141B2

(12) United States Patent
Choi et al.

(10) Patent No.: US 11,735,141 B2
(45) **Date of Patent: *Aug. 22, 2023**

(54) DISPLAY DEVICE AND METHOD OF DRIVING THE SAME

(71) Applicant: Samsung Display Co., Ltd., Yongin-Si (KR)

(72) Inventors: Eun Jin Choi, Yongin-si (KR); Won Jin Seo, Yongin-si (KR); Ki Hyun Pyun, Yongin-si (KR)

(73) Assignee: Samsung Display Co., Ltd., Yongin-Si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 17/745,160

(22) Filed: May 16, 2022

(65) Prior Publication Data

US 2022/0277707 A1 Sep. 1, 2022

Related U.S. Application Data

(63) Continuation of application No. 17/079,281, filed on Oct. 23, 2020, now Pat. No. 11,361,731.

(30) Foreign Application Priority Data

Mar. 26, 2020 (KR) ..... 10-2020-0036764

(51) Int. Cl.
*G09G 5/10* (2006.01)

(52) U.S. Cl.
CPC ..... *G09G 5/10* (2013.01); *G09G 2310/027* (2013.01); *G09G 2310/0267* (2013.01);
(Continued)

(58) Field of Classification Search
CPC ..... G09G 5/10; G09G 2310/0267; G09G 2310/027; G09G 2310/08;
(Continued)

(56) References Cited

U.S. PATENT DOCUMENTS 7,573,447 B2 8/2009 Oh et al.
7,609,248 B2 10/2009 Hong et al.
(Continued)

FOREIGN PATENT DOCUMENTS

EP 1591990 A1 11/2005
EP 2113904 A2 11/2009
(Continued)

*Primary Examiner* — Antonio Xavier
(74) *Attorney, Agent, or Firm* — Innovation Counsel LLP

(57) ABSTRACT

Provided herein may be a display device. The display device may include a display panel including a plurality of unit blocks disposed in a display area, the plurality of unit blocks including a first area displaying a logo or a banner, a second area having largest load value and a third area disposed between the first area and the second area, a display panel driver configured to generate data voltages based on input image data, and a zonal compensator configured to receive the input image data, to calculate load values of the input image data for the plurality of unit blocks, respectively, and to control luminance of each of the first area and the third area based on a location difference between the first area and the second area and a load value difference between the first area and the second area.

16 Claims, 23 Drawing Sheets

(52) U.S. Cl.
CPC . *G09G 2310/08* (2013.01); *G09G 2320/0285* (2013.01); *G09G 2320/0626* (2013.01); *G09G 2320/0686* (2013.01); *G09G 2330/023* (2013.01)

(58) Field of Classification Search
CPC ... G09G 2320/0285; G09G 2320/0626; G09G 2320/0686; G09G 2330/023; G09G 3/2007; G09G 2320/0233; G09G 3/2081; G09G 5/14; G09G 2320/0271; G09G 2320/103; G09G 3/20; G09G 2330/021; G09G 2340/00; G09G 2340/16; G09G 2360/16; Y02D 10/00
See application file for complete search history.

(56) References Cited

U.S. PATENT DOCUMENTS

| | | | | |
|---|---|---|---|---|
| 9,691,353 | B2 | 6/2017 | Joo et al. | |
| 11,341,932 | B2 * | 5/2022 | Choi | G09G 3/20 |
| 11,361,731 | B2 * | 6/2022 | Choi | G09G 3/2081 |
| 2008/0042938 | A1 | 2/2008 | Cok | |
| 2008/0174544 | A1 | 7/2008 | Ueda et al. | |
| 2008/0204475 | A1 | 8/2008 | Kim et al. | |
| 2009/0028460 | A1 | 1/2009 | Jung et al. | |
| 2011/0141090 | A1 | 6/2011 | Hong et al. | |
| 2015/0255019 | A1 | 9/2015 | Park et al. | |
| 2016/0217731 | A1 | 7/2016 | Joo et al. | |
| 2017/0032744 | A1 | 2/2017 | Yoo et al. | |
| 2018/0053462 | A1 * | 2/2018 | Bae | G09G 3/2074 |
| 2018/0246375 | A1 | 8/2018 | Zhang | |
| 2021/0201849 | A1 | 7/2021 | Choi et al. | |

FOREIGN PATENT DOCUMENTS

| | | | |
|---|---|---|---|
| EP | 2375400 | A2 | 10/2011 |
| EP | 3792906 | A1 | 3/2021 |
| EP | 3843069 | A1 | 6/2021 |
| EP | 3886082 | A1 | 9/2021 |
| KR | 10-1096720 | B1 | 12/2011 |
| KR | 10-1097584 | B1 | 12/2011 |
| KR | 10-2016-0071886 | A | 6/2016 |
| KR | 10-2016-0092537 | A | 8/2016 |
| KR | 10-2016-0095673 | A | 8/2016 |
| KR | 10-2017-0132368 | A | 12/2017 |
| WO | 2019214246 | A1 | 11/2019 |

* cited by examiner

DISPLAY DEVICE AND METHOD OF DRIVING THE SAME

CROSS-REFERENCE TO RELATED APPLICATION

This application is a continuation application of U.S. patent application Ser. No. 17/079,281, filed on Oct. 23, 2020, which claims priority under 35 USC § 119 to Korean patent application number No. 10-2020-0036764, filed on Mar. 26, 2020, the entire disclosure of which is incorporated herein in its entirety by reference.

BACKGROUND

1. Technical Field

Various embodiments of the present disclosure relate to a display device and a method of driving the display device.

2. Related Art

A display device may include a display panel and a display panel driver. The display panel driver may receive a control signal and input image data from the outside (e.g., a graphics processor or the like), and may generate a data voltage. The display panel may display an image in a display area based on the data voltage. Also, the display panel may display a logo (or a banner) in a logo area (or a banner area) based on the data voltage. The display panel driver may control the luminance of the logo area (or the banner area) so as to be lower than that of other parts, whereby power consumption of the display device may be reduced.

SUMMARY

Various embodiments of the present disclosure are directed to a display device that maintains the luminance of an area on which the eyes of a user are focused at a predetermined or higher level while performing zonal attenuation compensation for reducing power consumption.

An embodiment of the present disclosure may provide for a display device. The display device may include a display panel including a plurality of unit blocks disposed in a display area, the plurality of unit blocks including a first area displaying a logo or a banner, a second area having largest load value and a third area disposed between the first area and the second area, a display panel driver configured to generate data voltages based on input image data, and a zonal compensator configured to receive the input image data, to calculate load values of the input image data for the plurality of unit blocks, respectively, and to control luminance of each of the first area and the third area based on a location difference between the first area and the second area and a load value difference between the first area and the second area.

In an embodiment, the zonal compensator may generate corrected image data by applying a gain curve to the input image data, the display panel driver may generate the data voltages based on the corrected image data, and the gain curve may include gain values corresponding to spatial locations in the display area.

In an embodiment, when the location difference is equal to or greater than a preset reference distance or when the load value difference is equal to or less than a preset reference load value, the zonal compensator may decrease the luminance of the third area for an identical grayscale value as approaching the first area from the second area, and may control the luminance of the first area so as to be identical to the lowest luminance of the third area.

In an embodiment, the zonal compensator may decrease the gain value of the gain curve corresponding to the first area as the location difference increases.

In an embodiment, the zonal compensator may decrease the decreasing rate of the gain value of the gain curve as approaching the first area from the second area and as the location difference increases.

In an embodiment, the zonal compensator may decrease the gain value of the gain curve corresponding to the first area as the load value difference decreases.

In an embodiment, the gain curve may decrease nonlinearly as approaching the first area from the second area.

In an embodiment, the gain curve may decrease linearly as approaching the first area from the second area.

In an embodiment, when the location difference is less than a preset reference distance and when the load value difference is greater than a preset reference load value, the zonal compensator may control the luminance of the first area, the second area and the third area so as to be identical for an identical grayscale value.

In an embodiment, the gain values of the gain curve may have an identical value regardless of the spatial location in the display area.

In an embodiment, the zonal compensator may include an image analyzer configured to receive the input image data, to calculate a first location corresponding to the first area, a second location corresponding to the second area, a first load value corresponding to the first area, and a second load value corresponding to the second area using the input image data corresponding to a preset frame, a gain generator connected to the image analyzer and configured to calculate the location difference between the first location and the second location, to calculate the load value difference between the first load value and the second load value, and to generate the gain curve based on the location difference and the load value difference, and a data compensator connected to the gain generator and configured to generate the corrected image data by applying the gain curve to the input image data.

In an embodiment, the image analyzer may calculate the first load value and the second load value based on the grayscale values of the input image data that respectively correspond to the first area and the second area.

In an embodiment, the image analyzer may calculate the first load value and the second load value based on on-pixel ratios (OPR) that respectively correspond to the first area and the second area.

In an embodiment, the image analyzer may calculate the first load value and the second load value based on data change amounts that respectively correspond to the first area and the second area.

In an embodiment, the image analyzer may set the location of a pixel within the first area that is closest to the second area as the first location, and may set the location of a pixel within the second area that is closest to the first area as the second location.

In an embodiment, the gain generator may include a comparator connected the image analyzer and configured to generate a gain control signal based on the result of comparing the location difference with a preset reference distance and the result of comparing the load value difference with a preset load value, and a gain controller connected to the comparator and configured to generate the gain curve based on the gain control signal.

In an embodiment, the zonal compensator may generate corrected image data by applying a preset lookup table to the input image data, the display panel driver may generate the data voltages based on the corrected image data, and the lookup table may include gain values corresponding to spatial locations in the display area.

An embodiment of the present disclosure may provide for a method of driving a display device including a display panel configured to display a logo or a banner in the first area of a display area. The method may include dividing the display area into a plurality of unit blocks and calculating load values of input image data for the plurality of unit blocks, respectively, extracting a second area having largest load value among the plurality of unit blocks, calculating the location difference between the first area and the second area, calculating a load value difference, which is the difference between a first load value corresponding to the first area and a second load value corresponding to the second area, and controlling the luminance of a third area between the first area and the second area and the luminance of the first area based on the location difference and the load value difference.

In an embodiment, controlling the luminance may include comparing the location difference with a preset reference distance, comparing the load value difference with a preset reference load value, and when the location difference is equal to or greater than the reference distance or when the load value difference is equal to or less than the reference load value, for an identical grayscale value, decreasing the luminance of the third area as approaching the first area from the second area, and controlling the luminance of the first area so as to be identical to lowest luminance of the third area.

In an embodiment, controlling the luminance may further include controlling the luminance of the first area, the second area and third area so as to be identical for an identical grayscale value when the location difference is less than the reference distance and when the load value difference is greater than the reference load value.

DETAILED DESCRIPTION

Figure 1:
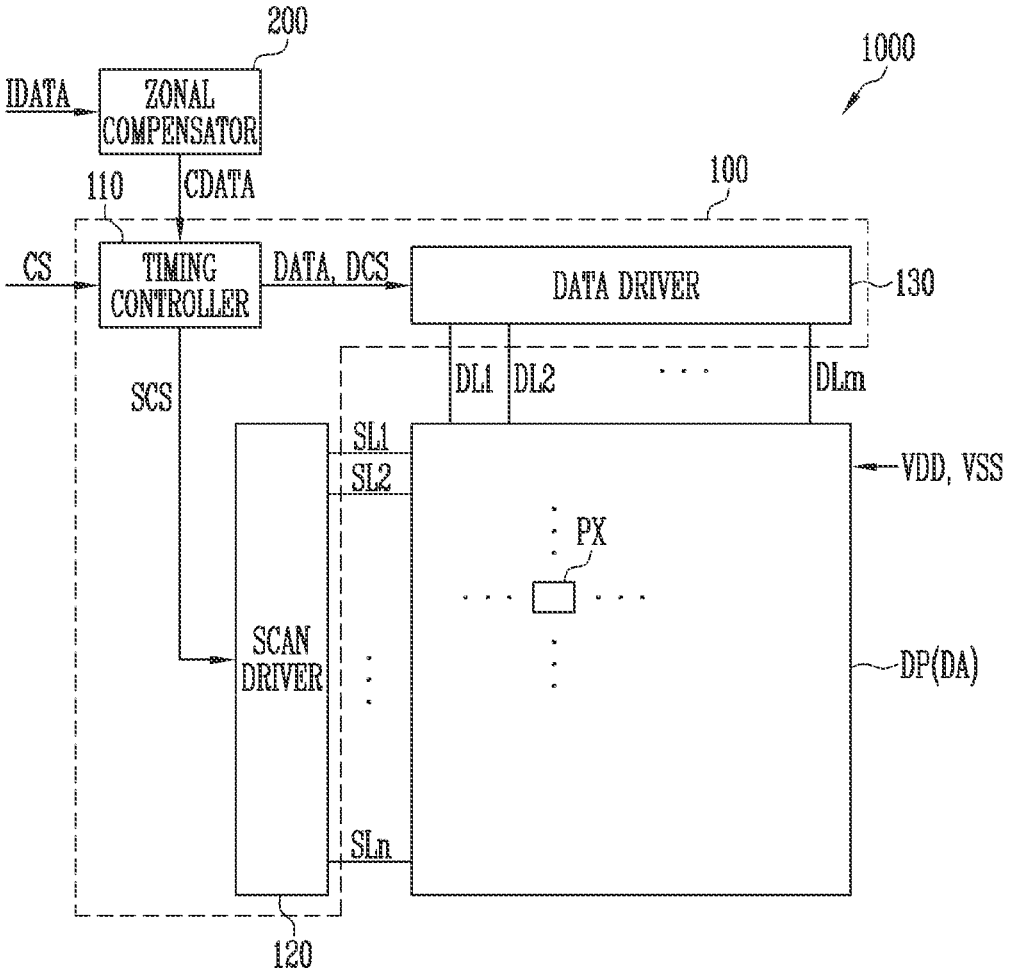
FIG. 1 is a block diagram illustrating a display device according to embodiments of the present disclosure.

Because the present disclosure may be variously changed and may have various forms, specific embodiments will be described in detail below with reference to the attached drawings. However, it should be understood that those embodiments are not intended to limit the present disclosure to specific disclosure forms and that they include all changes, equivalents or modifications included in the spirit and scope of the present disclosure.

Like reference numerals are used to denote like elements in the drawings. In the drawings, lengths and sizes of layers and regions may be exaggerated for clarity. Terms such as 'first' and 'second' may be used to describe various components, but they should not limit the various components. Those terms are only used for the purpose of differentiating a component from other components. For example, a first component may be referred to as a second component, and a second component may be referred to as a first component and so forth without departing from the spirit and scope of the present disclosure. Furthermore, a singular form may include a plural form as long as it is not specifically mentioned in a sentence.

In the present specification, it should be understood that the terms such as "include" or "have" are merely intended to indicate that features, numbers, steps, operations, components, parts, or combinations thereof are present, and are not intended to exclude a possibility that one or more other features, numbers, steps, operations, components, parts, or combinations thereof will be present or added.

It is also noted that in this specification, "connected/coupled" refers to one component not only directly coupling another component but also indirectly coupling another component through an intermediate component.

Hereinafter, embodiments of the present disclosure will be described in detail with reference to the accompanying drawings.

Figure 2A:
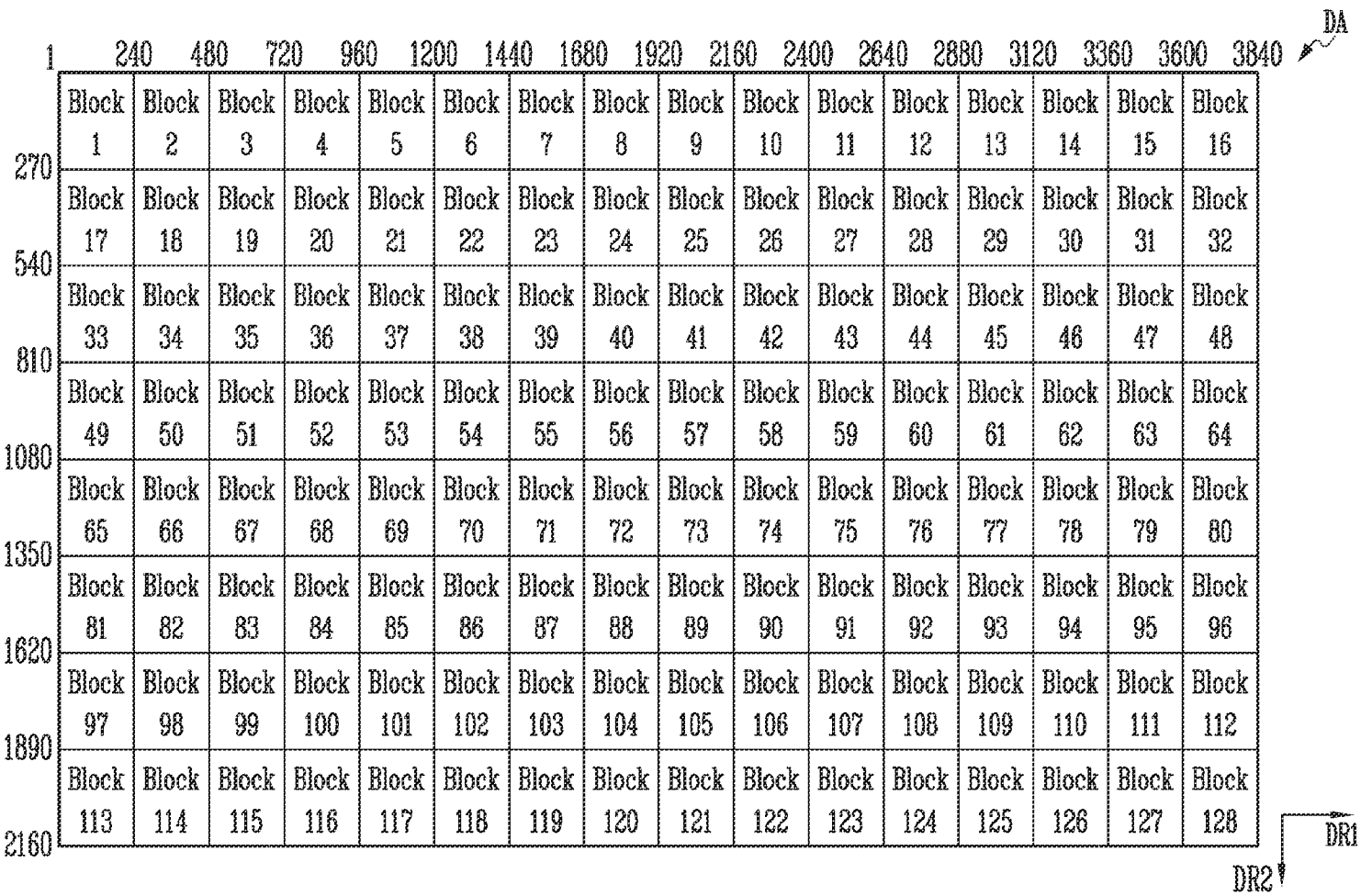
FIG. 2A and FIG. 2B are diagrams illustrating the display area of a display panel included in the display device of FIG. 1.
Figure 2B:
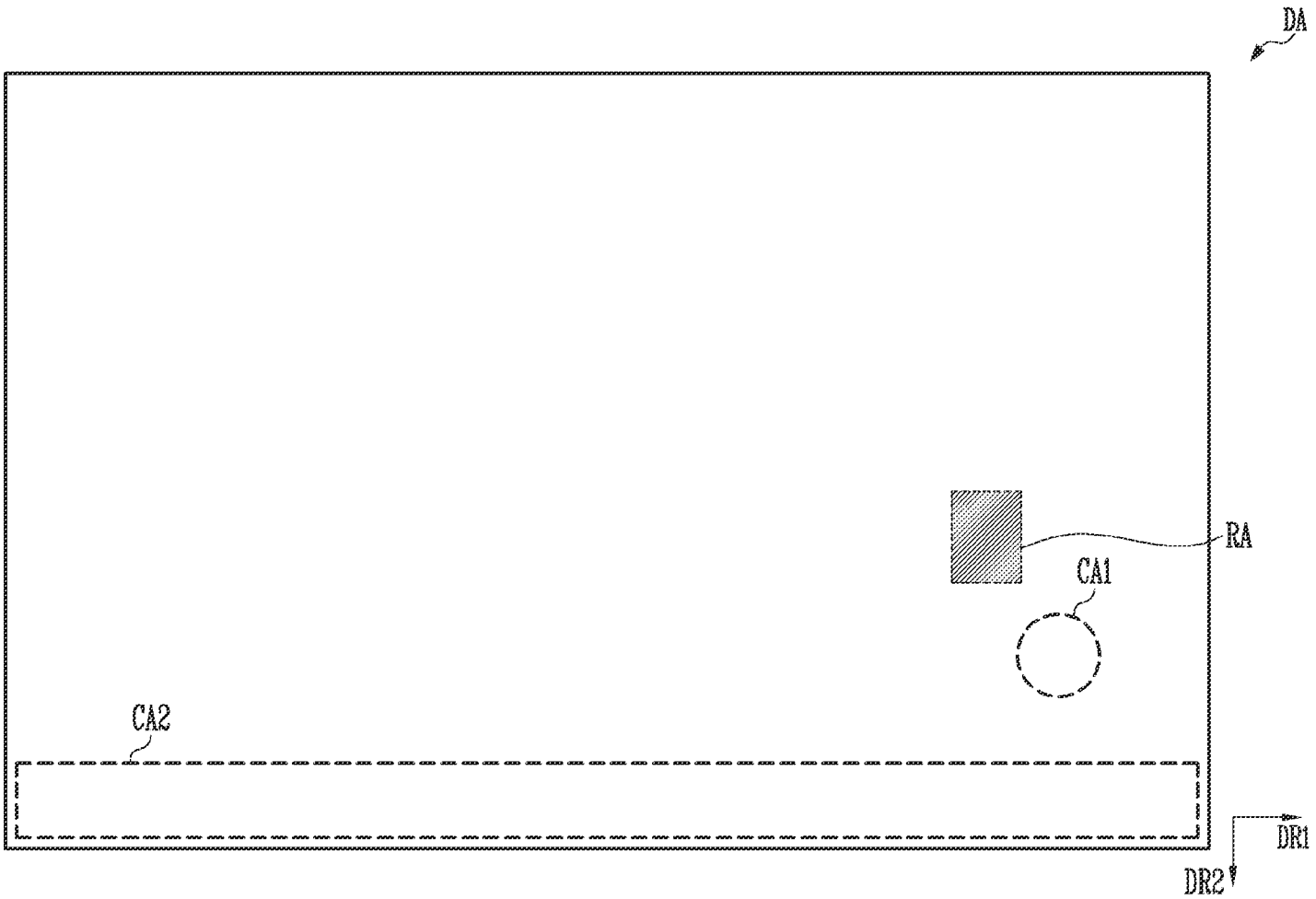

FIG. 1 is a block diagram illustrating a display device according to embodiments of the present disclosure, and FIG. 2A and FIG. 2B are diagrams illustrating the display area of a display panel included in the display device of FIG. 1.

Referring to FIGS. 1 to 2B, a display device 1000 may include a display panel DP, a display panel driver 100, and a zonal compensator 200.

The display panel DP may include a plurality of scan lines SL1 to SLn, a plurality of data lines DL1 to DLm, and a plurality of pixels PX.

The pixels PX may be coupled to at least one of the scan lines SL1 to SLn and at least one of the data lines DL1 to DLm. Meanwhile, the pixels PX may be supplied with the voltages of first power VDD and second power VSS from the outside. Here, the first power VDD and the second power VSS are voltages required for the operation of the pixels PX. For example, the first power VDD may have a voltage level higher than the voltage level of the second power VSS.

In an embodiment, the display panel DP may display an image in a display area DA based on a data voltage. Here, the display area DA may include a plurality of unit blocks (Block1 to Block128 of FIG. 2A).

In an embodiment, the display area DA may include a compensation area (or a first area). Here, the compensation area may include a logo area CA1 (or a first compensation area) and a banner area CA2 (or a second compensation area).

The logo area CA1 may be disposed at the edge of the display area DA. In FIG. 2B, the logo area CA1 is illustrated as being disposed at the corner in the first direction DR1 and the second direction DR2 of the display area DA. However, this is an example, and the area in which the logo area CA1 is disposed is not limited thereto. For example, the logo area CA1 may be alternatively disposed at the corner opposite the corner in the first direction DR1 and the second direction DR2 of the display area DA.

The banner area CA2 may be disposed at the bottom of the display area DA. In FIG. 2B, the banner area CA2 is illustrated as being disposed along the first direction DR1 at the end of the second direction DR2 of the display area DA (that is, disposed at the bottom of the display area DA). However, this is an example, and the location of the banner area CA2 is not limited thereto. For example, the banner area CA2 may be alternatively disposed at the top, the side, or the like of the display area DA.

The compensation area is described as including the logo area CA1 and/or the banner area CA2, but the compensation area is not limited thereto. For example, the compensation area may be a predetermined area in which the same image is displayed for a long time, or the like.

The display panel DP may display a logo in the logo area CA1 according to the data voltage, and may display a banner in the banner area CA2 according to the data voltage.

The display panel driver 100 may generate data signal DATA for displaying an image in the display area DA and displaying a logo or a banner in the compensation area (that is, the logo area CA1 or the banner area CA2) according to input image data IDATA (or corrected image data CDATA).

In an embodiment, the display panel driver 100 may include a timing controller 110, a scan driver 120, and a data driver 130.

The timing controller 110 may receive a control signal CS from the outside (e.g., a graphics processor), and may receive the corrected image data CDATA from the zonal compensator 200. The timing controller 110 may generate a scan control signal SCS and a data control signal DCS in response to the control signal CS, and may generate the data signal DATA by converting the corrected image data CDATA. Here, the control signal CS may include a vertical synchronization signal, a horizontal synchronization signal, a clock signal, and the like.

The scan driver 120 may generate scan signals in response to the scan control signal SCS supplied from the timing controller 110. Here, the scan control signal SCS may include a scan start signal, a scan clock signal, and the like. The scan driver 120 may sequentially supply scan signals, each having a turn-on level pulse, to the scan lines SL1 to SLn.

The data driver 130 may generate data voltages based on the data signal DATA and the data control signal DCS which are supplied from the timing controller 110, and may supply the data voltages to the data lines DL1 to DLm. The data driver 130 may generate the data voltages in an analog form using the data signal DATA in a digital form. For example, the data driver 130 may sample grayscale values included in the data signal DATA, and may supply the data voltages corresponding to the grayscale values to the data lines DL1 to DLm in units of pixel rows. Here, the data control signal DCS may include a data clock signal, a data enable signal, and the like.

The zonal compensator 200 may receive the input image data IDATA from the outside (e.g., the graphics processor), and may calculate the load value of the input image data IDATA.

In an embodiment, the zonal compensator 200 may divide the display DA into a plurality of unit blocks Block1 to Block128, for example, and may calculate the load values of the input image data IDATA for the respective unit blocks.

For example, the zonal compensator 200 may divide the display area DA into 16 blocks in the first direction DR1 and divide the same into 8 blocks in the second direction DR2, as illustrated in FIG. 2A. As the result, the display area DA may be divided into a total of 128 unit blocks, that is, first to 128th unit blocks Block1 to Block128. In an embodiment, the first to 128th unit blocks Block1 to Block128 may have an equal size (or the same number of pixels). However, the number of unit blocks Block1 to Block128 is not limited thereto. The zonal compensator 200 may divide the display area DA into 32 blocks in the first direction DR1 and divide the same into 16 blocks in the second direction DR2, thereby dividing the display area DA into a total of 512 unit blocks.

The spatial locations of the pixels PX included in the display panel DP may be set depending on the resolution of the display device 1000. When the resolution of the display device 1000 is N×M, N spatial locations may be set along the first direction DR1 and M spatial locations may be set along the second direction DR2. Accordingly, a total of N×M spatial locations may be set. For example, the numbers illustrated in FIG. 2A (e.g., 1, 240, 480, . . . , 3840, or 1, 270, 540, . . . , 2160) may indicate the relative spatial locations of the pixels PX included in the display panel DP. For example, the number '1' may indicate the first pixel PX, among the pixels PX arranged in the first direction DR1, or the first pixel PX, among the pixels PX arranged in the second direction DR2, the number '3840' may indicate the $3840^{th}$ pixel PX among the pixels PX arranged in the first direction DR1, and the number '2160' may indicate the $2160^{th}$ pixel PX among the pixels PX arranged in the second direction DR2. As described above, the numbers (1, 240, 480, . . . , 3840 or 1, 270, 540, . . . , 2160) illustrated in FIG. 2A may indicate the relative spatial locations (or the relative distances (lengths)) of the pixels PX. However, a method of setting the spatial locations is not limited to the above example, and the spatial locations may be set based on preset coordinates regardless of the resolution of the display device 1000. Hereinafter, a description will be made on the assumption that the resolution of the display device 1000 is 3840×2160 and that the spatial locations in the display area DA are set depending on the relative locations of the pixels PX included in the display panel DP for the convenience of description.

In an embodiment, the zonal compensator 200 may calculate the load value of the input image data IDATA corresponding to the compensation area CA1 or CA2 (or a first load value).

The configuration in which the zonal compensator 200 calculates the load values of the input image data IDATA will be described later with reference to FIG. 3 and FIG. 4.

The zonal compensator 200 may extract a reference area RA (or a second area) in which the load value of the input image data IDATA is largest from the display area DA.

In an embodiment, the zonal compensator 200 may extract the reference area RA based on the load values of the input image data IDATA which are calculated for the respective unit blocks. For example, the zonal compensator 200 may calculate the load values of the respective unit blocks Block1 to Block128 and may extract at least one unit block having the largest load value as the reference area RA.

The zonal compensator 200 may calculate the respective spatial locations of the compensation area CA1 or CA2 and the reference area RA. The zonal compensator 200 may calculate a first location for the compensation area CA1 or CA2 and a second location for the reference area RA.

The zonal compensator 200 may generate corrected image data CDATA by correcting the input image data IDATA based on the spatial location and the load value of each of the compensation area CA1 or CA2 and the reference area RA.

In an embodiment, the zonal compensator 200 may control the luminance of an image displayed in an intermediate area (or a third area) between the compensation area CA1 or CA2 and the reference area RA, and the luminance of the logo or banner displayed in the compensation area CA1 or CA2 based on the location difference between the compensation area CA1 or CA2 and the reference area RA and a load value difference which is the difference between the load value of the compensation area CA1 or CA2 and the load value of the reference area RA.

For example, when the location difference between the compensation area CA1 or CA2 and the reference area RA is equal to or greater than a preset reference distance or when the difference between the load value of the compensation area CA1 or CA2 and that of the reference area RA is equal to or less than a preset reference load value, the zonal compensator 200 may decrease the luminance of a displayed image as the intermediate area approaches the compensation area CA1 or CA2 for the same grayscale. Also, when the location difference between the compensation area CA1 or CA2 and the reference area RA is equal to or greater than the preset reference distance or when the difference between the load value of the compensation area CA1 or CA2 and that of the reference area RA is equal to or less than the reference load value, the zonal compensator 200 may correct the input image data IDATA such that the lowest luminance of the image displayed in the intermediate area is the same as the luminance of the logo or banner displayed in the compensation area CA1 or CA2. Here, the same grayscale condition may indicate the case in which the display device 1000 drives the pixels PX included in the display panel DP using the same grayscale value.

For example, when the location difference between the compensation area CA1 or CA2 and the reference area RA is less than the reference distance and when the difference between the load value of the compensation area CA1 or CA2 and that of the reference area RA is greater than the reference load value, the zonal compensator 200 may correct the input image data IDATA such that the luminance of the image displayed in the reference area RA and the intermediate area is the same as the luminance of the logo or banner displayed in the compensation area CA1 or CA2 under the condition of the same grayscale.

The zonal compensator 200 may generate corrected image data CDATA by correcting the input image data IDATA by applying gain values corresponding to respective spatial locations to the input image data IDATA depending on the spatial locations (or the spatial locations of the pixels PX). Accordingly, the luminance of the display area DA may be changed according to the data voltages generated based on the corrected image data CDATA.

In an embodiment, the zonal compensator 200 corrects the input image data IDATA by applying a gain curve to the input image data IDATA, thereby generating corrected image data CDATA. Here, the gain curve may include the gain values corresponding to the spatial locations in the display area DA. For example, the gain curve may include the gain values corresponding to the respective pixels PX included in the display panel DP. In an example, the gain curve may include the gain values corresponding to the respective unit blocks Block1 to Block128, which is described with reference to FIG. 2A.

Here, each of the gain values has a value equal to or greater than 0 and equal to or less than 1, and the luminance of the display area DA may be controlled based on the gain values. For example, the greater the gain value, the higher the luminance of the display area DA. Meanwhile, the luminance of the image based on the corrected image data CDATA generated by applying the gain value of 1 to the input image data IDATA may be the same as the luminance corresponding to the input image data IDATA. The luminance of the image based on the corrected image data CDATA generated by applying the gain value that is greater than 0 and less than 1 to the input image data IDATA may be lower than the luminance corresponding to the input image data IDATA. Also, the luminance of the image based on the corrected image data CDATA generated by applying the gain value of 0 to the input image data IDATA may be the same as the black luminance.

However, the configuration in which the zonal compensator 200 generates the corrected image data CDATA is not limited to the above description. For example, the zonal compensator 200 may generate the corrected image data CDATA by applying a preset lookup table (LUT) to the input image data IDATA. Here, the lookup table may include gain values corresponding to spatial locations in the display area DA of the display panel DP (or the spatial locations of the pixels PX). Accordingly, the luminance of an image displayed in the intermediate area between the compensation area CA1 or CA2 and the reference area RA and the luminance of the logo or banner displayed in the compensation area (that is, the logo area CA1 or the banner area CA2) may be controlled.

Meanwhile, the zonal compensator 200 is illustrated as being separate from the timing controller 110 in FIG. 1, and the zonal compensator 200 is described as generating corrected image data CDATA by correcting the input image data IDATA supplied from the outside and as supplying the corrected image data CDATA to the timing controller 110. However, at least some components of the zonal compensator 200 may be included in the timing controller 110. Also, the timing controller 110 including the zonal compensator 200 may generate the corrected image data CDATA by correcting the input image data IDATA supplied from the outside.

As described above with reference to FIGS. 1 to 2B, the zonal compensator 200 generates corrected image data CDATA by correcting the input image data IDATA, thereby performing zonal attenuation compensation for differentially controlling the luminance depending on the spatial location in the display area DA (or the spatial locations of the pixels PX). Through zonal attenuation compensation, the power consumption of the display device 1000 may be reduced.

The luminance decrease caused by zonal attenuation compensation may be applied not only to the logo area CA1 or the banner area CA2 but also to peripheral areas of the logo area CA1 or the banner area CA2. Also, an image may include an area that is required to be displayed with high luminance. When the area required to be displayed with high luminance is close to the logo area CA1 or the banner area CA2, the area required to be displayed with high luminance may also be affected by zonal attenuation. As the result, visibility of the area required to be displayed with high luminance may be reduced.

The zonal compensator 200 may differentially control the luminance of the intermediate area between the compensation area CA1 or CA2 and the reference area RA and the luminance of the compensation area CA1 or CA2 based on the location difference between the compensation area CA1 or CA2 and the reference area RA, and the difference between the load value of the compensation area CA1 or CA2 and that of the reference area RA. That is, the zonal compensator 200 maintains the luminance of the area on which the eyes of a user are focused, such as the reference area, at a predetermined or higher level while performing zonal attenuation compensation for reducing the power consumption of the display device 1000, thereby preventing visibility to the user from being reduced.

Figure 3:
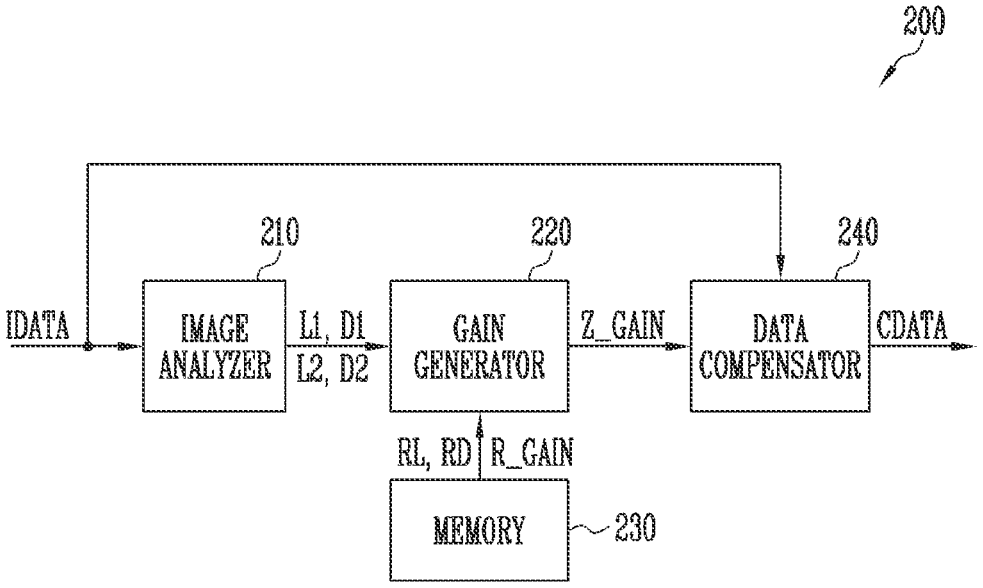
FIG. 3 is a block diagram illustrating an example of a zonal compensator included in the display device of FIG. 1.
Figure 4:
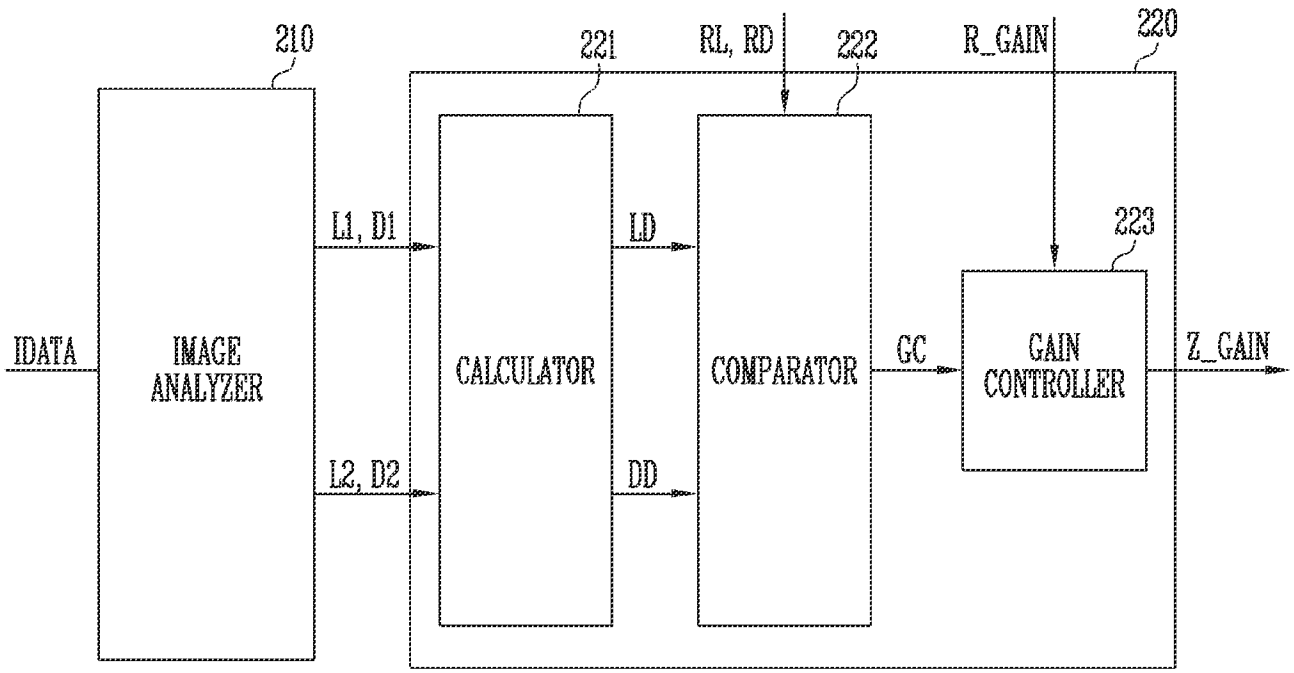
FIG. 4 is a block diagram illustrating an example of an image analyzer and a gain generator included in the zonal compensator of FIG. 3.
Figure 5:
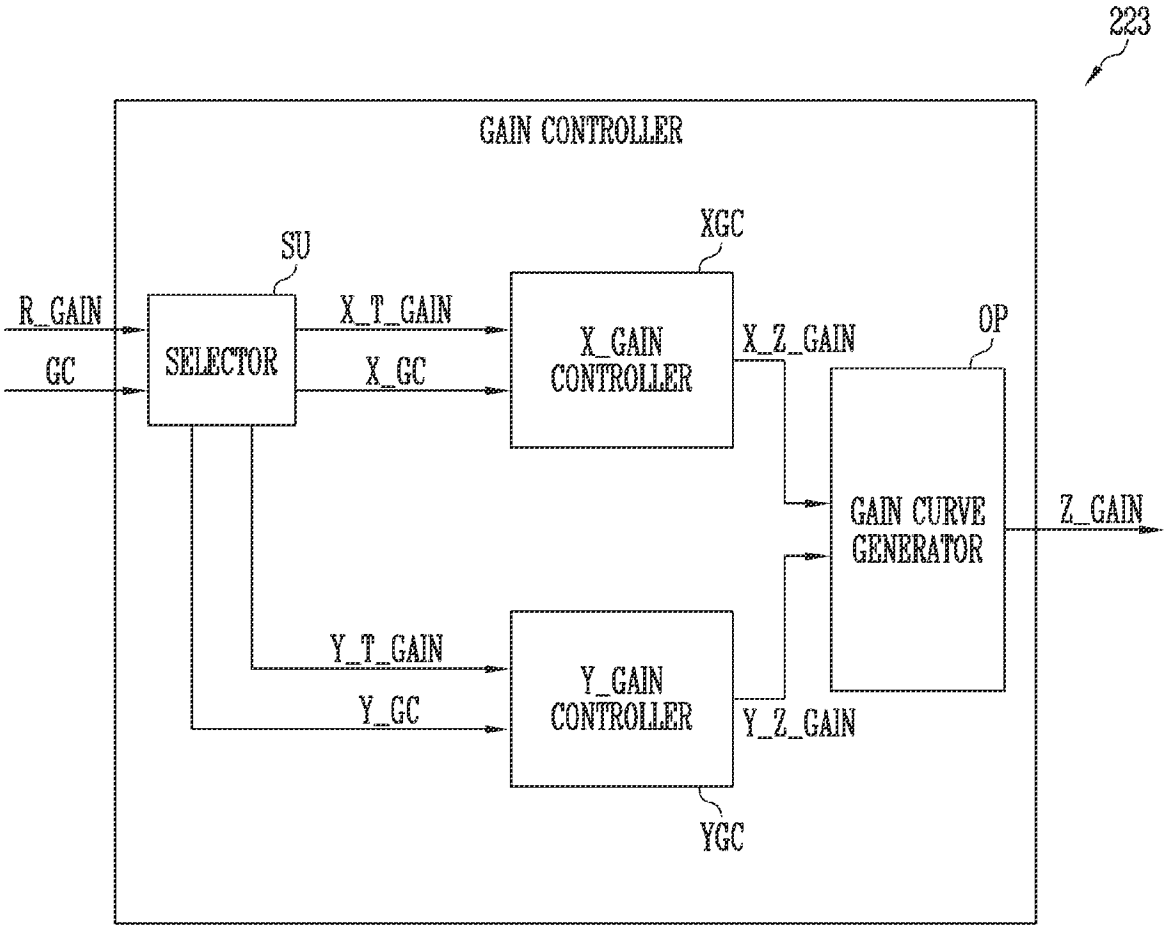
FIG. 5 is a block diagram illustrating an example of a gain controller included in the gain generator of FIG. 4.

FIG. 3 is a block diagram illustrating an example of the zonal compensator included in the display device of FIG. 1, FIG. 4 is a block diagram illustrating an example of an image analyzer and a gain generator included in the zonal compensator of FIG. 3, and FIG. 5 is a block diagram illustrating an example of a gain controller included in the gain generator of FIG. 4.

Referring to FIGS. 2A to 5, the zonal compensator 200 may include an image analyzer 210, a gain generator 220, a memory 230, and a data compensator 240.

The image analyzer 210 may calculate the load values of input image data IDATA based on the input image data IDATA supplied from the outside.

In an embodiment, the image analyzer 210 may calculate the first load value L1 of the input image data IDATA corresponding to the compensation area CA1 or CA2.

In an embodiment, the image analyzer 210 may calculate the load values of the input image data IDATA for respective unit blocks, and may extract at least one unit block in which the load value of the input image data IDATA is largest among the unit blocks Block1 to Block128 as the reference area RA. The image analyzer 210 may calculate the load value corresponding to the reference area RA as a second load value L2.

The image analyzer 210 may calculate the first and second load values L1 and L2 based on the input image data IDATA corresponding to a single frame (e.g., the current frame).

In an embodiment, the image analyzer 210 may calculate the first and second load values L1 and L2 based on the grayscale values of the input image data IDATA (e.g., the sum of the grayscale values, the average of the grayscale values, or the like). For example, the image analyzer 210 may calculate the first load value L1 from the grayscale values of the pixels included in the input image data IDATA corresponding to the compensation area CA1 or CA2. Similarly, the image analyzer 210 may calculate the second load value L2 from the grayscale values of the pixels included in the input image data IDATA corresponding to the reference area RA.

In an embodiment, the image analyzer 210 may calculate the on-pixel ratios (OPR) of the input image data IDATA, and may calculate the first and second load values L1 and L2 based on the calculated on-pixel ratios. For example, the image analyzer 210 may calculate the on-pixel ratios based on the ratio of the pixels emitting light to the pixels that respectively correspond to the compensation area CA1 or CA2 and the reference area RA based on the input image data IDATA. For example, the image analyzer 210 may calculate the first load value L1 corresponding to the compensation area CA1 or CA2 from the ratio of the pixels emitting light to the pixels disposed in the compensation area CA1 or CA2. Similarly, the image analyzer 210 may calculate the second load value L2 corresponding to the reference area RA from the ratio of the pixels emitting light to the pixels disposed in the reference area RA.

In an embodiment, the image analyzer 210 may calculate the data change amounts of the input image data IDATA and may calculate the first and second load values L1 and L2 based on the calculated data change amounts. For example, the image analyzer 210 may calculate the data change amount in the compensation area CA1 or CA2 based on the input image data IDATA of the current frame and the input image data IDATA of the previous frame in the compensation area CA1 or CA2, and may calculate the first load value L1 based on the calculated data change amount in the compensation area CA1 or CA2. Similarly, the image analyzer 210 may calculate the data change amount in the reference area RA based on the input image data IDATA of the current frame and the input image data IDATA of the previous frame in the reference area RA, and may calculate the second load value L2 based on the calculated data change amount in the reference area RA.

The image analyzer 210 may calculate a first location D1 corresponding to the compensation area CA1 or CA2 and a second location D2 corresponding to the reference area RA.

In an embodiment, the image analyzer 210 may set the location of a pixel within the compensation area CA1 or CA2 that is closest to the reference area RA as the first location D1, and may set the location of a pixel within the reference area RA that is closest to the compensation area CA1 or CA2 as the second location D2.

However, this is an example, and the configuration in which the image analyzer 210 sets the first and second locations D1 and D2 is not limited thereto. For example, the image analyzer 210 may set the location of a pixel within the compensation area CA1 or CA2 that is farthest from the reference area RA as the first location D1, and may set the location of a pixel within the reference area RA that is farthest from the compensation area CA1 or CA2 as the second location D2. In an example, the image analyzer 210 may set the location of a pixel that is closest to the center of the compensation area CA1 or CA2 as the first location D1, and may set the location of a pixel that is closest to the center of the reference area RA as the second location D2.

The image analyzer 210 may calculate the first load value L1, the second load value L2, the first location D1, and the second location D2 using the input image data IDATA corresponding to a preset frame. For example, the image analyzer 210 may calculate the first load value L1, the second load value L2, the first location D1, and the second location D2 in every preset frame period.

The image analyzer 210 may provide the calculated first load value L1, the calculated second load value L2, the calculated first location D1, and the calculated second location D2 to the gain generator 220.

The gain generator 220 may generate a gain curve Z_GAIN based on the first load value L1, the second load value L2, the first location D1, and the second location D2 provided from the image analyzer 210 and a reference load value RL, a reference distance RD, and reference gain values R_GAIN provided from the memory 230.

In an embodiment, the gain generator 220 may calculate the location difference DD between the first location D1 and the second location D2, calculate the load value difference LD between the first load value L1 and the second load value L2, and generate the gain curve Z_GAIN based on the location difference DD and the load value difference LD.

In an embodiment, the gain generator 220 may include a calculator (221 of FIG. 4), a comparator (222 of FIG. 4), and a gain controller (223 of FIG. 4).

The calculator 221 may calculate the location difference DD between the compensation area CA1 or CA2 and the reference area RA based on the first location D1 and the second location D2 provided from the image analyzer 210.

The calculator 221 may calculate the load value difference LD, which is the difference between the load value of the compensation area CA1 or CA2 and that of the reference area RA based on the first load value L1 and the second load value L2 provided from the image analyzer 210.

The calculator 221 may provide the location difference DD and the load value difference LD to the comparator 222.

The comparator 222 may generate a gain control signal GC based on the result of comparing the location difference DD provided from the calculator 221 with the reference distance RD provided from the memory 230 and on the result of comparing the load value difference LD provided from the calculator 221 with the reference load value RL provided from the memory 230. Meanwhile, the gain control signal GC may include information about the location difference DD, information about the load value difference LD, and information about the comparison results.

The gain controller 223 may generate the gain curve Z_GAIN based on the gain control signal GC provided from the comparator 222 and the reference gain values R_GAIN provided from the memory 230.

In an embodiment, the gain controller 223 may select one of the preset reference gain values R_GAIN based on the result of comparing the location difference DD with the reference distance RD and on the result of comparing the load value difference LD with the reference load value RL, and may generate the gain curve Z_GAIN based on the selected reference gain value R_GAIN.

The memory 230 may store the reference load value RL, the reference distance RD, and the reference gain values R_GAIN therein. Here, the reference load value RL and the reference distance RD may be experimentally set depending on the visibility to a user, or the like. For example, because the eyes of the user may be focused on the area having a high load value such as the reference area RA, the reference load value RL and the reference distance RD may be set such that the luminance of the reference area RA and the luminance of the periphery of the reference area RA are maintained at a predetermined or higher level.

The reference gain values R_GAIN may include gain values corresponding to the location difference DD and the load value difference LD. The reference gain values R_GAIN may include preset reference gain values R_GAIN corresponding to the first direction DR1 and preset reference gain values R_GAIN corresponding to the second direction DR2.

The data compensator 240 may correct the input image data IDATA based on the gain curve Z_GAIN provided from the gain generator 220. In an embodiment, the data compensator 240 may generate corrected image data CDATA by applying the gain curve Z_GAIN to the input image data IDATA.

In an embodiment, the gain generator 220 may determine whether or not to apply zonal attenuation compensation with reference to the comparison result provided from the comparator 222.

For example, when the location difference DD between the compensation area CA1 or CA2 and the reference area RA is less than the preset reference distance RD and when the load value difference LD which is the difference between the load value of the compensation area CA1 or CA2 and that of the reference area RA is greater than the reference load value RL, the comparator 222 may generate the gain control signal GC such that the luminance of the image displayed in the reference area RA and the intermediate area is the same as the luminance of the logo or banner displayed in the compensation area CA1 or CA2 having the same grayscale value.

In this case, based on the gain control signal GC, the gain controller 223 may generate the gain curve Z_GAIN including the same gain value, regardless of the spatial location in the display area (DA of FIG. 2A). For example, the gain controller 223 may generate the gain curve Z_GAIN including the gain value of 1 regardless of the spatial location in the display area (DA of FIG. 2A).

Accordingly, the luminance of the image displayed in the reference area RA and the intermediate area and the luminance of the logo or banner displayed in the compensation area CA1 or CA2 may be the same as each other for pixels having the same gray scale value.

However, the operation is not limited to the above case, and the gain controller 223 may not generate the gain curve Z_GAIN when the gain generator 220 determines not to apply zonal attenuation compensation. Accordingly, the data compensator 240 may output the input image data IDATA without change as the corrected image data CDATA rather than correcting the input image data IDATA.

When the location difference DD between the compensation area CA1 or CA2 and the reference area RA is equal to or greater than the preset reference distance RD or when the load value difference LD, which is the difference between the load value of the compensation area CA1 or CA2 and that of the reference area RA, is equal to or less than the preset reference load value RL, the comparator 222 may generate the gain control signal GC such that, under the same grayscale condition, the luminance of the intermediate area decreases as approaching the compensation area CA1 or CA2 from the reference area RA and such that the lowest luminance of the intermediate area is the same as the luminance of the compensation area CA1 or CA2 for pixels having the same grayscale value.

In an embodiment, based on the magnitudes of the load value difference LD and the location difference DD, the comparator 222 may generate the gain control signal GC for controlling the gain value of the gain curve Z_GAIN corresponding to the compensation area CA1 or CA2 and/or the degree by which the gain value of the gain curve Z_GAIN decreases as approaching the compensation area CA1 or CA2 from the reference area RA. Accordingly, based on the gain control signal GC provided from the comparator 222, the gain controller 223 may control the gain value of the gain curve Z_GAIN corresponding to the compensation area CA1 or CA2 and/or the degree by which the gain value of the gain curve Z_GAIN decreases as approaching the compensation area CA1 or CA2 from the reference area RA.

For example, the comparator 222 may generate the gain control signal GC for decreasing the gain value of the gain curve Z_GAIN corresponding to the compensation area CA1 or CA2 as the location difference DD increases. Accordingly, the greater the location difference DD, the lower the luminance of the logo or banner displayed in the compensation area CA1 or CA2.

In an example, as the location difference DD increases under the condition of the same load value difference LD, the comparator 222 may generate the gain control signal GC for decreasing the decreasing rate of the gain value of the gain curve Z_GAIN as approaching the compensation area CA1 or CA2 from the reference area RA. Accordingly, as the location difference DD increases under the condition of the same load value difference LD and as approaching the compensation area CA1 or CA2 from the reference area RA, the decreasing rate of the luminance of the image displayed in the intermediate area may decrease.

In an example, the comparator 222 may generate the gain control signal GC for decreasing the gain value of the gain curve Z_GAIN corresponding to the compensation area CA1 or CA2 as the load value difference LD decreases. Accordingly, the less the load value difference LD, the lower the luminance of the logo or banner displayed in the compensation area CA1 or CA2.

The gain controller 223 may generate the gain curve Z_GAIN based on the gain control signal GC and the reference gain values R_GAIN.

As illustrated in FIG. 5, the gain controller 223 may include a selector SU, a first sub gain controller XGC, a second sub gain controller YGC, and a gain curve generator OP.

The selector SU may generate a first target gain value X_T_GAIN, a first sub gain control signal X_GC, a second target gain value Y_T_GAIN, and a second sub gain control signal Y_GC based on the preset reference gain values R_GAIN and the gain control signal GC. Here, the first target gain value X_T_GAIN and the second target gain value Y_T_GAIN may be gain values applied to the logo area CA1 or the banner area CA2.

The first sub gain controller XGC may generate a first sub gain curve X_Z_GAIN according to the first direction DR1 of the display area DA based on the first target gain value X_T_GAIN and the first sub gain control signal X_GC.

Similarly, the second sub gain controller YGC may generate a second sub gain curve Y_Z_GAIN according to the second direction DR2 of the display area DA based on the second target gain value Y_T_GAIN and the second sub gain control signal Y_GC.

The gain curve generator OP may generate the gain curve Z_GAIN by performing an operation on the first and second sub gain curves X_Z_GAIN and Y_Z_GAIN. Here, the gain curve generator OP performs an operation on the gain values of the first sub gain curve X_Z_GAIN corresponding to the spatial locations along the first direction DR1 of the display area DA, and the gain values of the second sub gain curve Y_Z_GAIN corresponding to the spatial locations along the second direction DR2 of the display area DA, thereby generating the gain curve Z_GAIN.

Figure 6A:
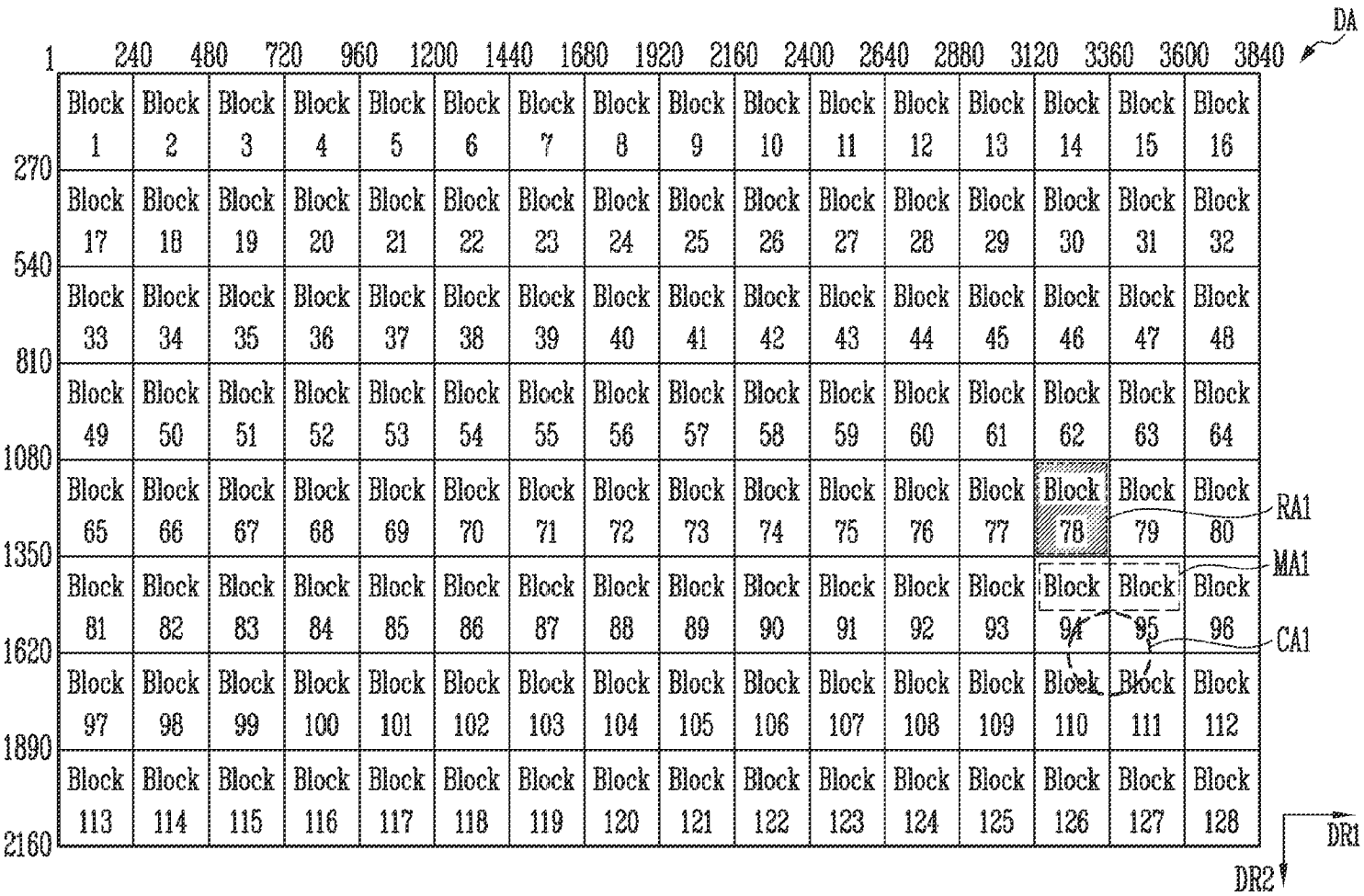
FIGS. 6A, 6B and 6C are diagrams illustrating an example of the operation of the zonal compensator of FIG. 3.
Figure 6B:
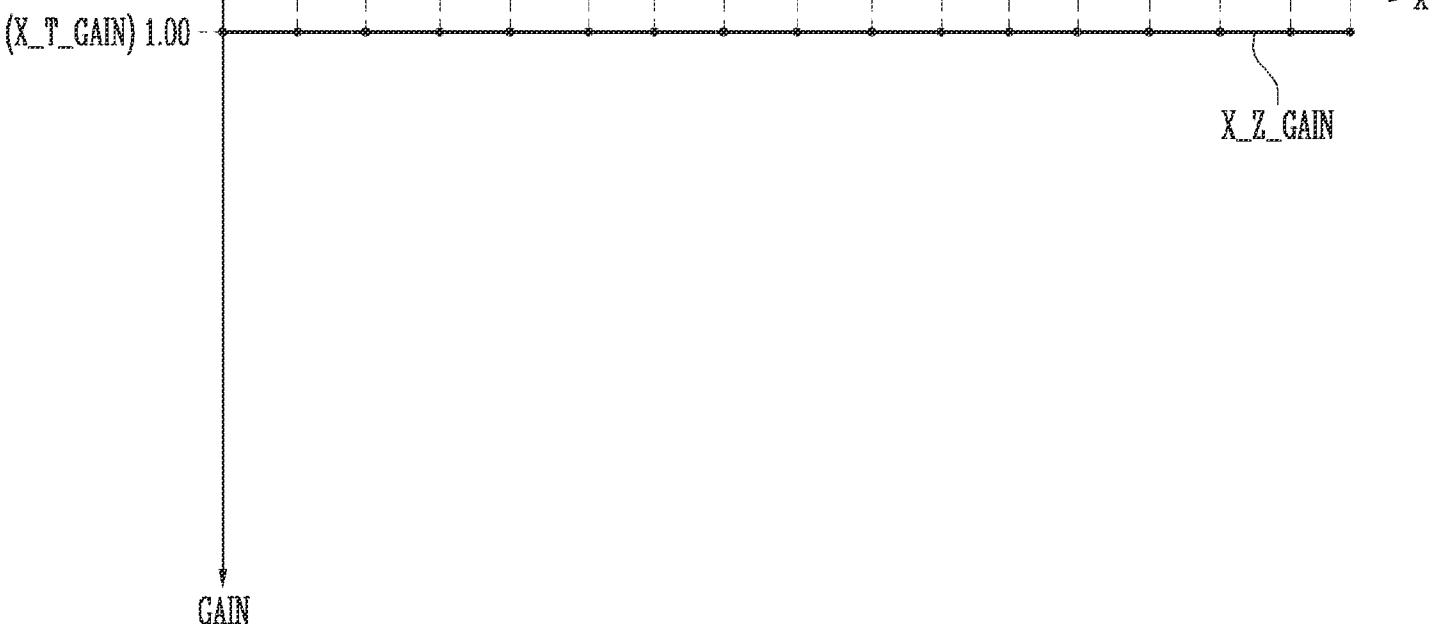
Figure 6C:
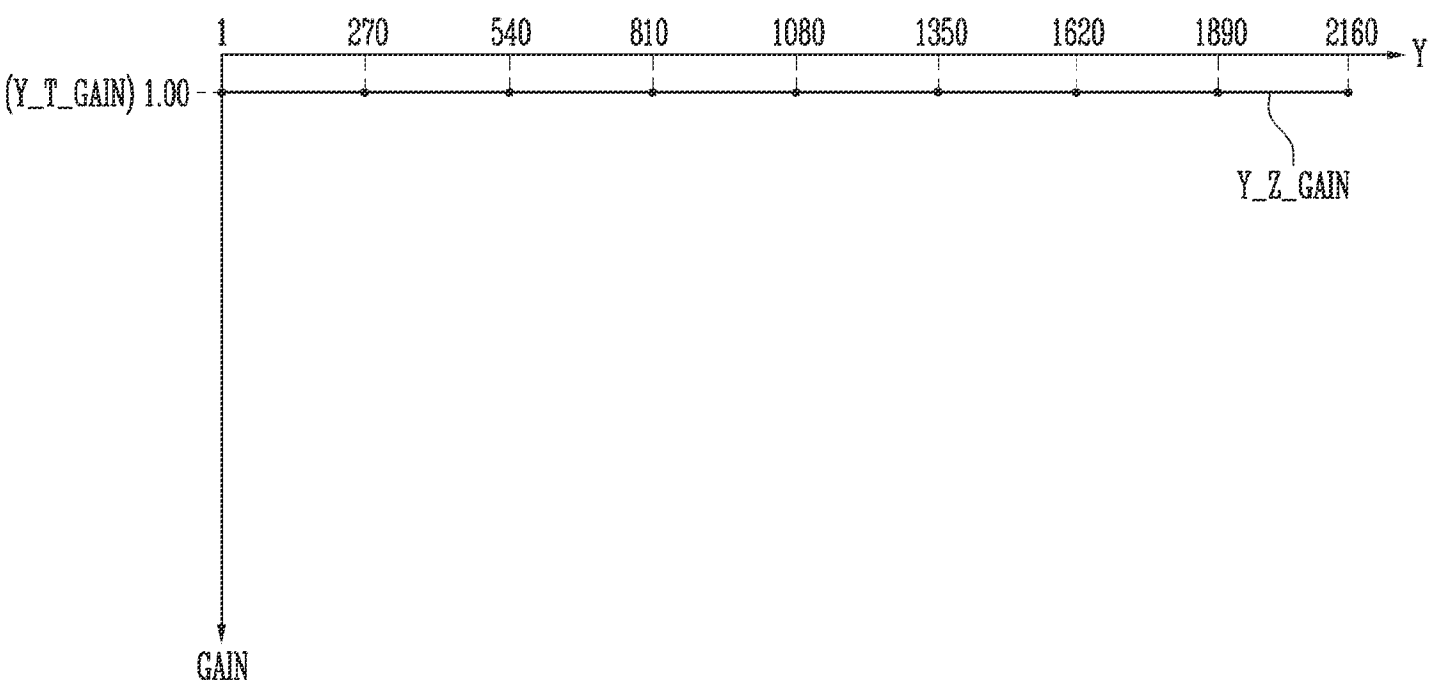

FIGS. 6A to 6C are diagrams illustrating an example of the operation of the zonal compensator of FIG. 3.

Referring to FIGS. 3 to 5 and FIGS. 6A to 6C, the location difference DD between the logo area CA1 and the reference area RA1 may be less than the reference distance RD, and the load value difference LD, which is the difference between the load value of the logo area CA1 and that of the reference area RA1, may be greater than the reference load value RL. In this case, zonal attenuation compensation may not be applied.

FIG. 6B and FIG. 6C may show the first and second sub gain curves X_Z_GAIN and Y_Z_GAIN that include gain values corresponding to the relative spatial locations of pixels according to the first direction DR1 and the second direction DR2 of the display panel DP.

Because the zonal compensator (200 of FIG. 1) does not apply zonal attenuation compensation to the display area DA, all of the first sub gain curve (X_Z_GAIN of FIG. 6B) and the second sub gain curve (Y_Z_GAIN of FIG. 6C) may include the same gain values (e.g., the value of '1') regardless of the spatial locations in the display area DA.

Accordingly, the luminance of the image displayed in the reference area RA1 and the intermediate area MA1 and the luminance of the logo displayed in the logo area CA1 (or the compensation area) may be the same for the same grayscale value.

As described above with reference to FIGS. 6A to 6C, when the location difference DD between the compensation area (that is, the logo area CA1) and the reference area RA1 is less than the reference distance RD and when the load value difference LD, which is the difference between the load values of the compensation area (that is, the logo area CA1) and the reference area RA1, is greater than the reference load value RL, the zonal compensator 200 (or the display device 1000) may not perform zonal attenuation compensation in order to prevent the luminance of the area on which the eyes of a user are focused (that is, the reference area RA1 having a large load value (the second load value L2) and the periphery of the reference area RA1) from being decreased.

Next, in order to describe the case in which the zonal compensator 200 (or the display device 1000) performs zonal attenuation compensation, FIGS. 7A to 7E and FIGS. 8A to 8E may be referred to.

FIGS. 7A to 7E are diagrams illustrating an example of the operation of the zonal compensator of FIG. 3.

Referring to FIGS. 3 to 5 and FIGS. 7A to 7E, the location difference DD between the logo area CA1' and the reference area RA1' may be equal to or greater than the reference distance RD or the load value difference LD, which is the difference between the load value of the logo area CA1' and that of the reference area RA1', may be equal to or less than the reference load value RL. In this case, zonal attenuation compensation may be applied.

In an embodiment, the comparator (222 of FIG. 4) may generate a gain control signal GC based on first location difference information about the location difference between the reference area RA1' and the logo area CA1' in the first direction DR1 (or the first location difference) and on second location difference information about the location difference therebetween in the second direction DR2 (or the second location difference).

Figure 7A:
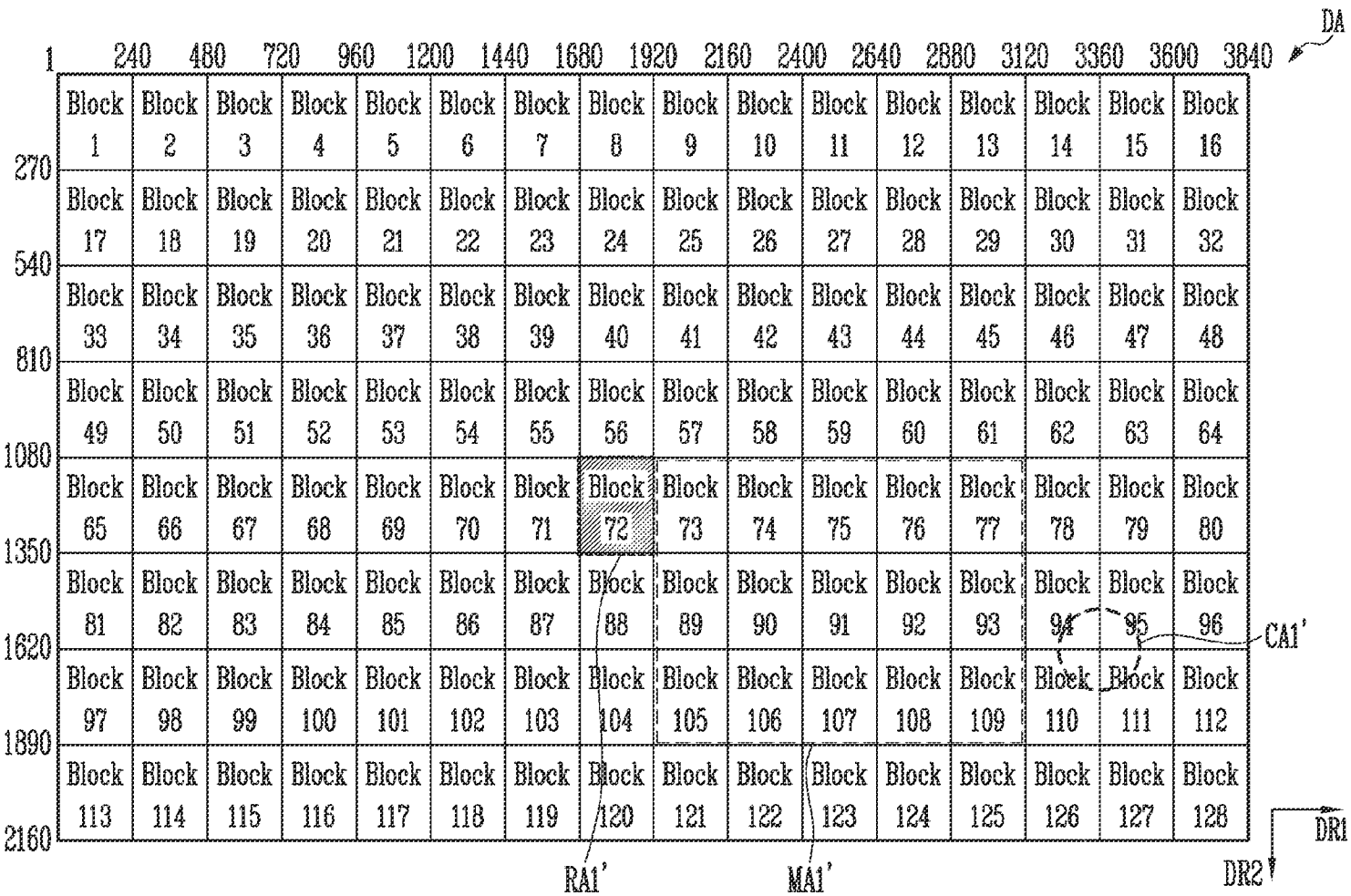
FIGS. 7A, 7B, 7C, 7D and 7E are diagrams illustrating an example of the operation of the zonal compensator of FIG. 3.

For example, the first location difference may be greater than the second location difference, as illustrated in FIG. 7A. In this case, the zonal compensator (200 of FIG. 1) may apply zonal attenuation compensation along the first direction DR1 only and may not apply zonal attenuation compensation along the second direction DR2.

Figure 7B:
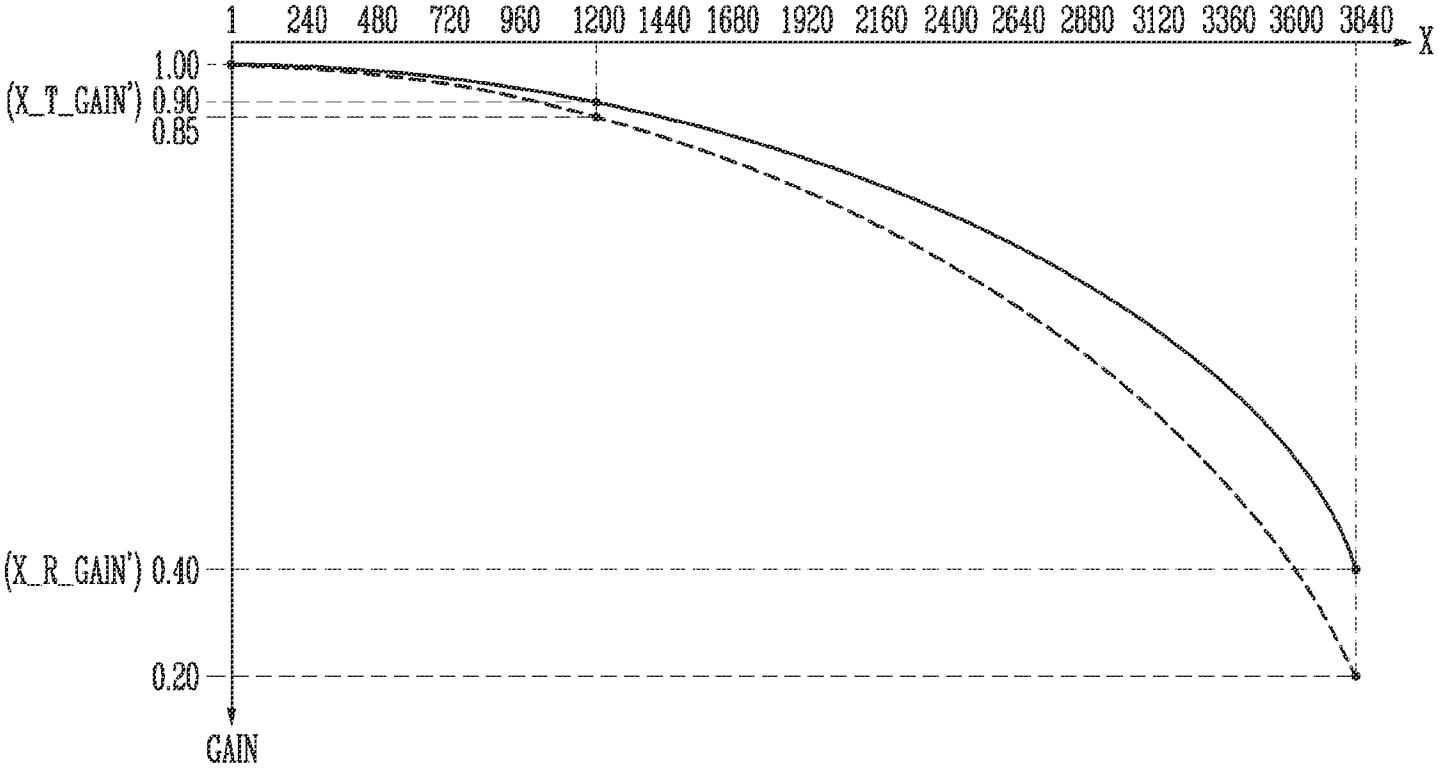
Figure 7C:
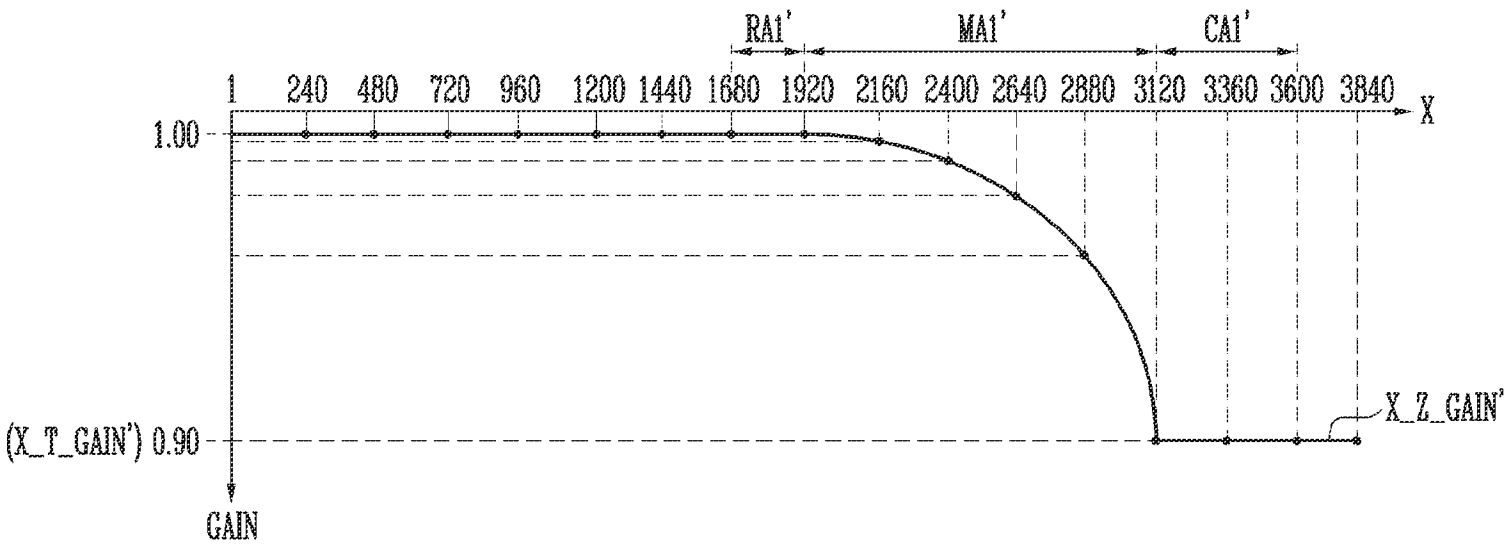

Accordingly, the gain controller (223 of FIG. 4) may select a value less than 1 (e.g., 0.90) as the first sub target gain value X_T_GAIN' for the first direction DR1 and decrease the gain value in the intermediate area MA1' as approaching the logo area CA1' from the reference area RA1', as illustrated in FIG. 7C. Here, the lowest gain value in the intermediate area MA1' (that is, 0.90) may be equal to the first sub target gain value X_T_GAIN' corresponding to the logo area CA1'. Meanwhile, all of the gain values for the areas excluding the intermediate area MA1' and the logo area CA1' from the display area DA including the reference area RA1' may have the value of 1.

In an embodiment, the less the load value difference LD, the less the reference gain value R_GAIN corresponding to the first direction DR1 (that is, the first sub reference gain value X_R_GAIN'). Accordingly, the smaller first sub target gain value X_T_GAIN' may be selected as the load value difference LD decreases.

For example, the value of 0.40 corresponding to the spatial distance of 3840, among the gain values of the curve marked with the solid line, may be selected as the first sub reference gain value X_R_GAIN' depending on the magnitude of the load value difference LD, as illustrated in FIG. 7B. In this case, among the gain values of the curve marked with the solid line, the value of 0.90 corresponding to the spatial distance of 1200 may be selected as the first sub target gain value X_T_GAIN' depending on the magnitude of the location difference DD.

Here, when the load value difference LD becomes smaller, the value of 0.20 corresponding to the spatial distance of 3840, among the gain values of the curve marked with the dotted line, may be selected as the first sub reference gain value, and the value of 0.85 corresponding to the spatial distance of 1200 may be selected as the first sub target gain value. Accordingly, as the load value difference LD decreases, the gain value of the gain curve Z_GAIN corresponding to the logo area CA1' decreases based on the lower first sub target gain value X_T_GAIN', whereby the luminance of the logo area CA1' may further decrease.

In an embodiment, as the location difference DD increases, the first sub target gain value X_T_GAIN' having a smaller value may be selected. For example, as the location difference DD increases, the value (e.g., the value of 0.40) corresponding to the spatial distance (e.g., the spatial distance of 3840) that is greater than the spatial distance of 1200 may be selected as the first sub target gain value X_T_GAIN', as illustrated in FIG. 7B. That is, as the location difference DD increases, the gain value of the gain curve Z_GAIN corresponding to the logo area CA1' decreases based on the smaller first sub target gain value X_T_GAIN', whereby the luminance of the logo area CA1' may decrease.

Figure 7D:
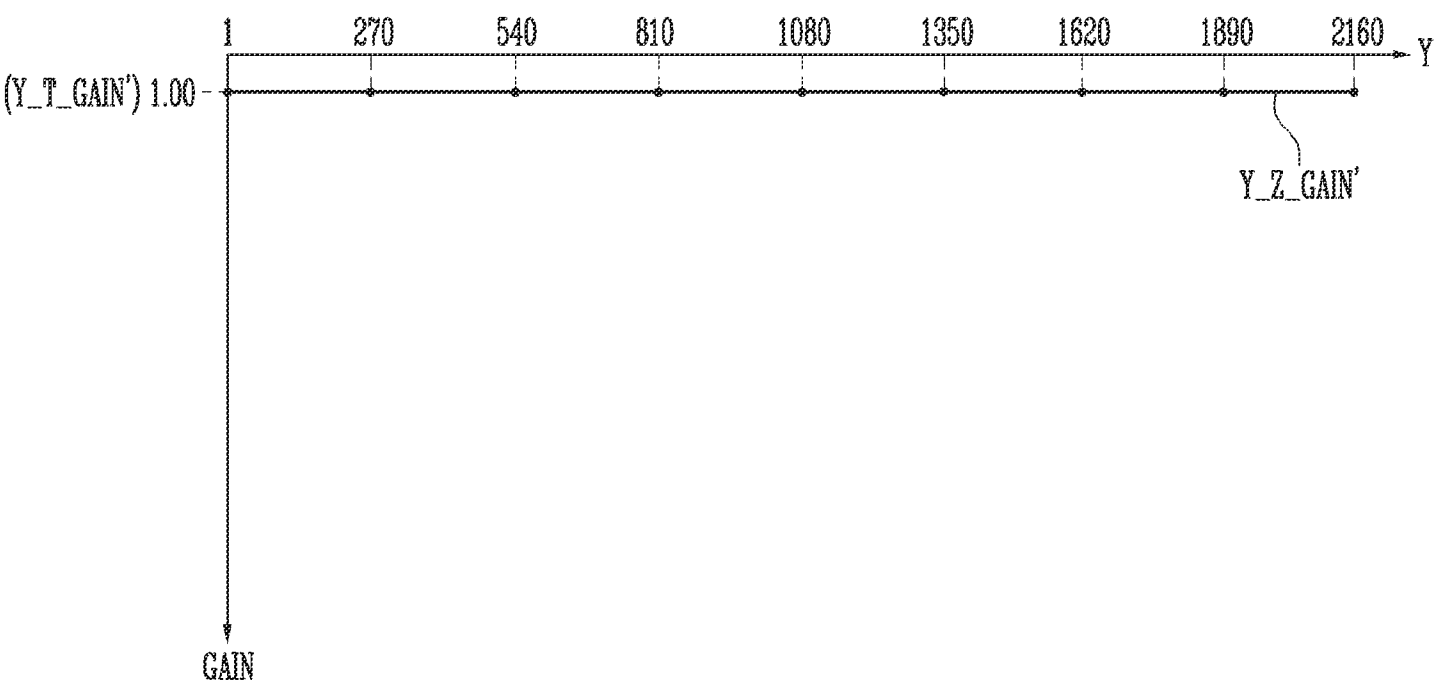

Meanwhile, because the second location difference is less than the first location difference, the second sub gain curve Y_Z_GAIN' may include the same gain values (e.g., the value of 1) regardless of the spatial location in the display area DA, as illustrated in FIG. 7D.

Accordingly, the gain curve Z_GAIN may include the same gain value regardless of the spatial locations along the second direction DR2, but may include different gain values depending on the spatial locations along the first direction DR1.

Figure 7E:
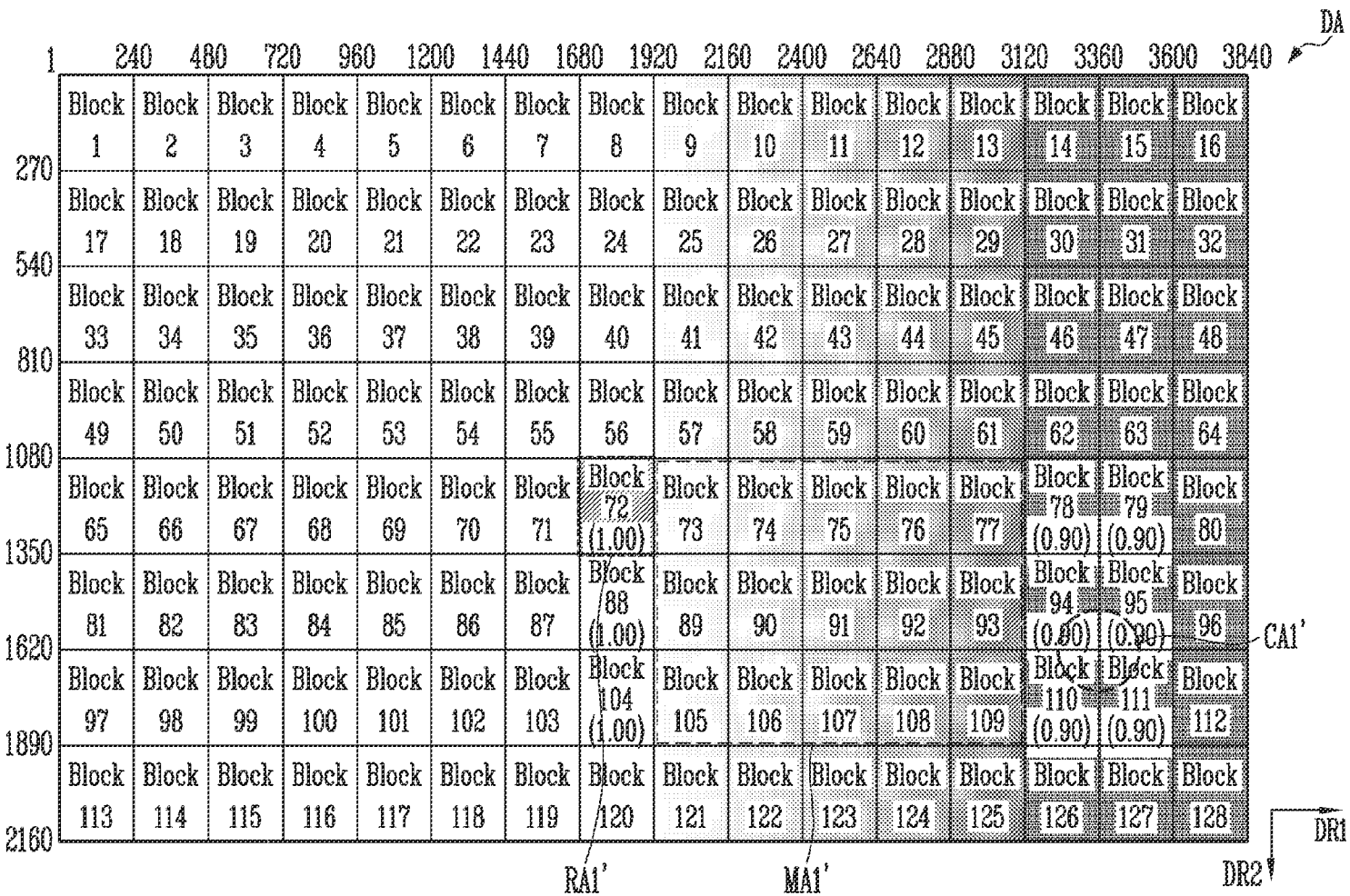

For example, in the case of the image displayed by applying the gain curve Z_GAIN to the input image data IDATA, the largest gain value (e.g., the value of 1.00) may be applied to the reference area RA1', the gain values applied to the intermediate area MA1' may gradually decrease as approaching the logo area CA1' from the reference area RA1', and the lowest gain value in the intermediate area MA1' and the gain value applied to the logo area CA1' (e.g., the value of 0.90 as the target gain value) may be the smallest, as illustrated in FIG. 7E. Here, under the same grayscale condition, the luminance of the intermediate area MA1' may gradually decrease as approaching the logo area CA1' from the reference area RA1 and the lowest luminance of the intermediate area MA1' may be the same as the luminance of the logo area CA1'.

FIGS. 8A to 8E are diagrams illustrating an example of the operation of the zonal compensator of FIG. 3.

In FIGS. 8A to 8E, the case in which the location difference between the reference area RA1" and the logo area CA1" in the first direction DR1 (or the first distance) is less than the location difference therebetween in the second direction DR2 (or the second location difference) will be described. Meanwhile, in FIGS. 8A to 8E, the same reference numerals are used to designate the components that are the same as or similar to the components described with reference to FIGS. 7A to 7E, and a repeated description will be omitted.

Referring to FIGS. 3 to 5 and FIGS. 8A to 8E, the location difference DD between the logo area CA1" and the reference area RA1" may be equal to or greater than the reference distance RD or the load value difference LD, which is the difference between the load value of the logo area CA1" and that of the reference area RA1", may be equal to or less than the reference load value RL. In this case, zonal attenuation compensation may be applied.

Figure 8A:
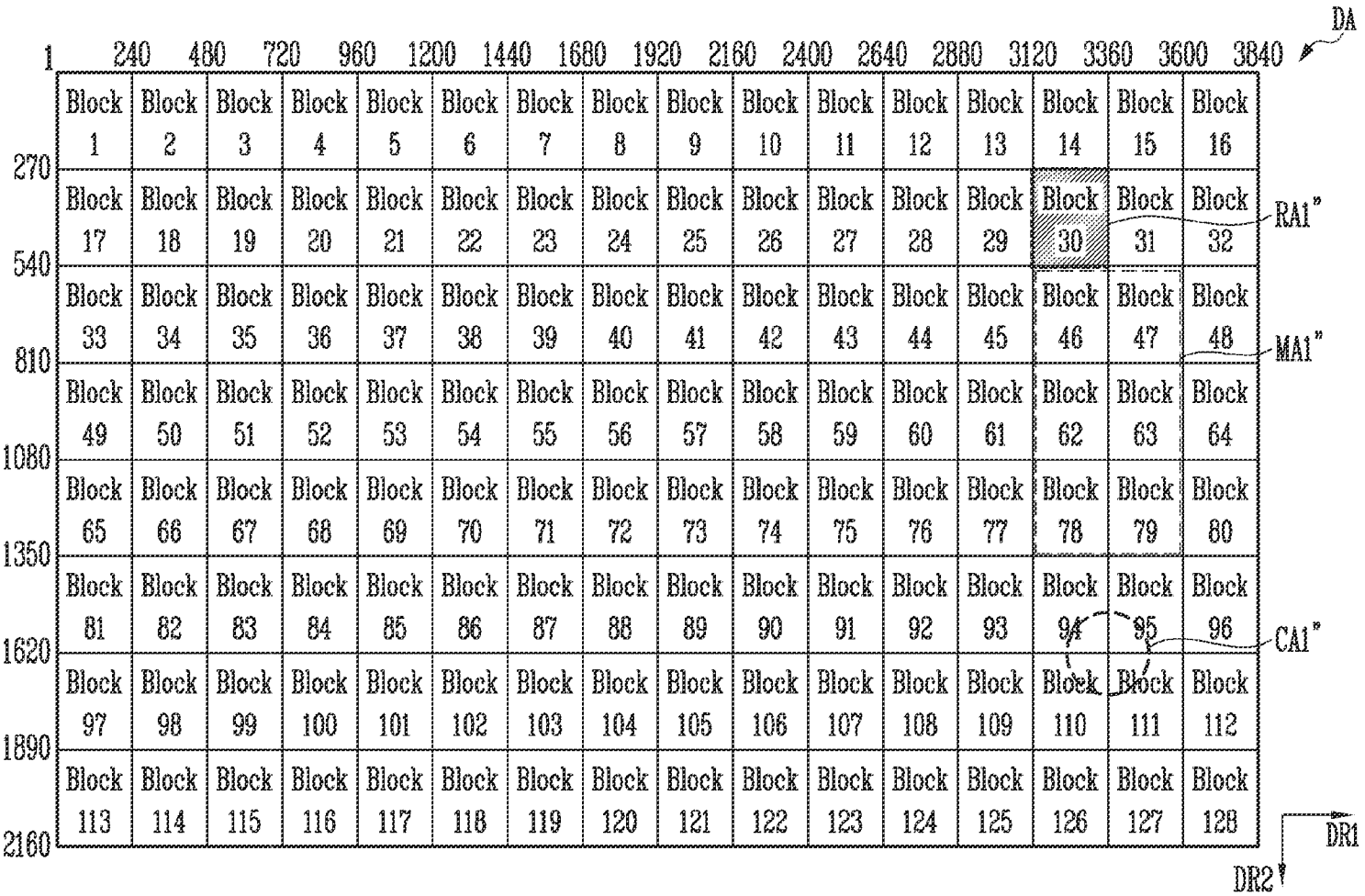
FIGS. 8A, 8B, 8C, 8D and 8E are diagrams illustrating an example of the operation of the zonal compensator of FIG. 3.

Here, as illustrated in FIG. 8A, the second location difference may be greater than the first location difference. In this case, the zonal compensator (200 of FIG. 1) may apply zonal attenuation compensation along the second direction DR2 only and may not apply zonal attenuation compensation along the first direction DR1.

Figure 8B:
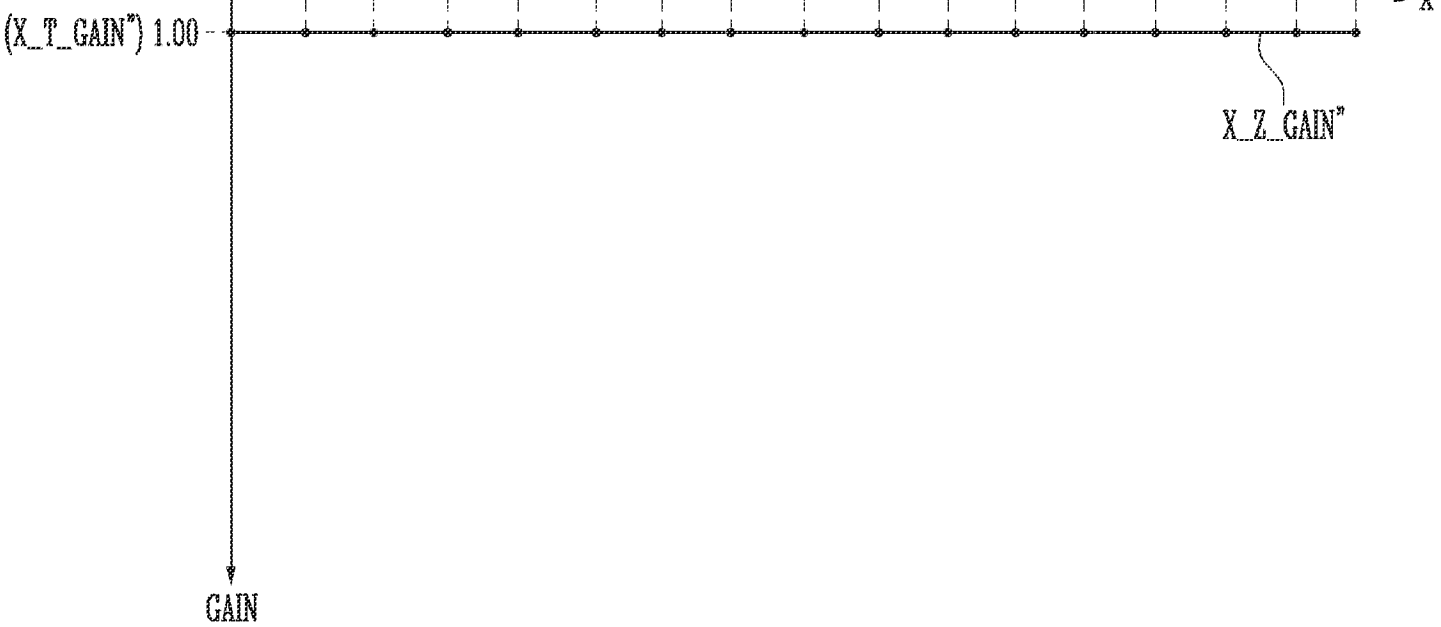
Figure 8C:
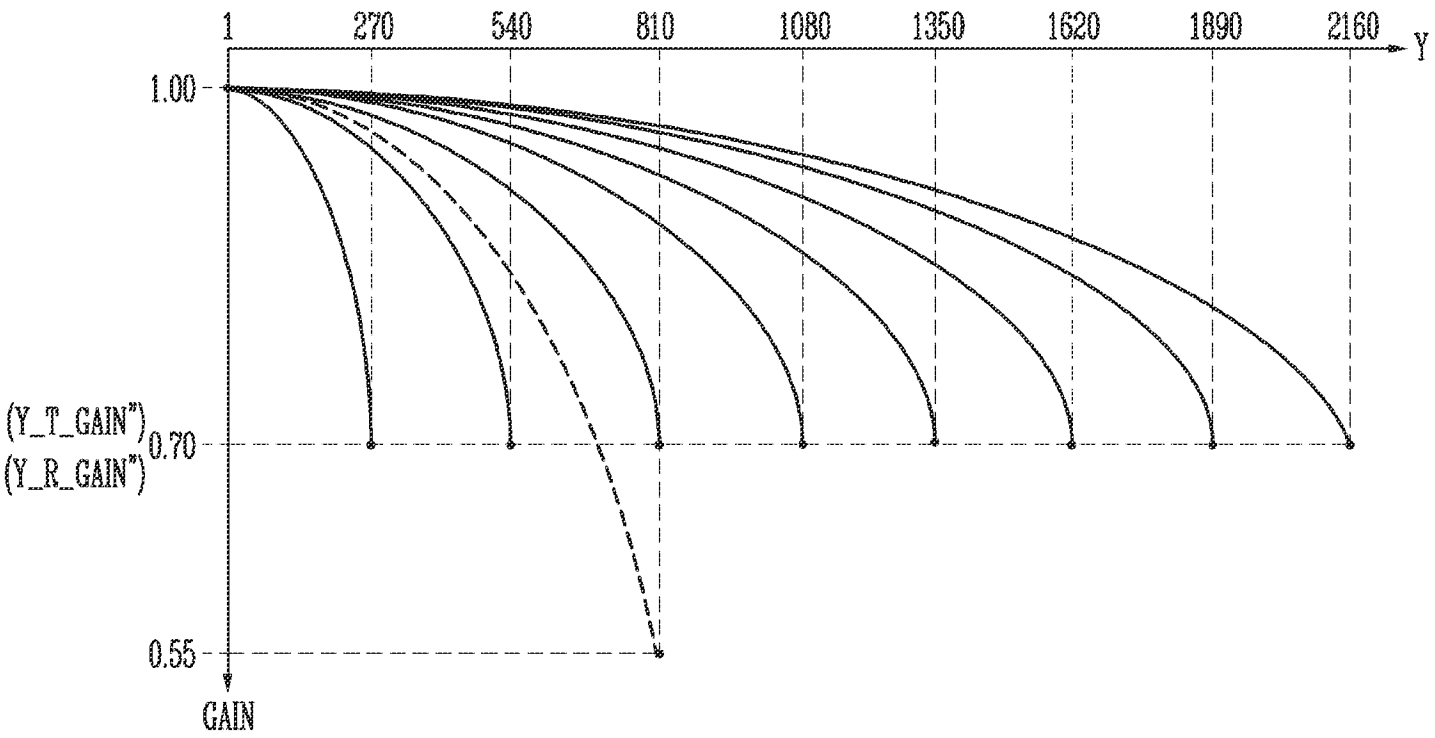
Figure 8D:
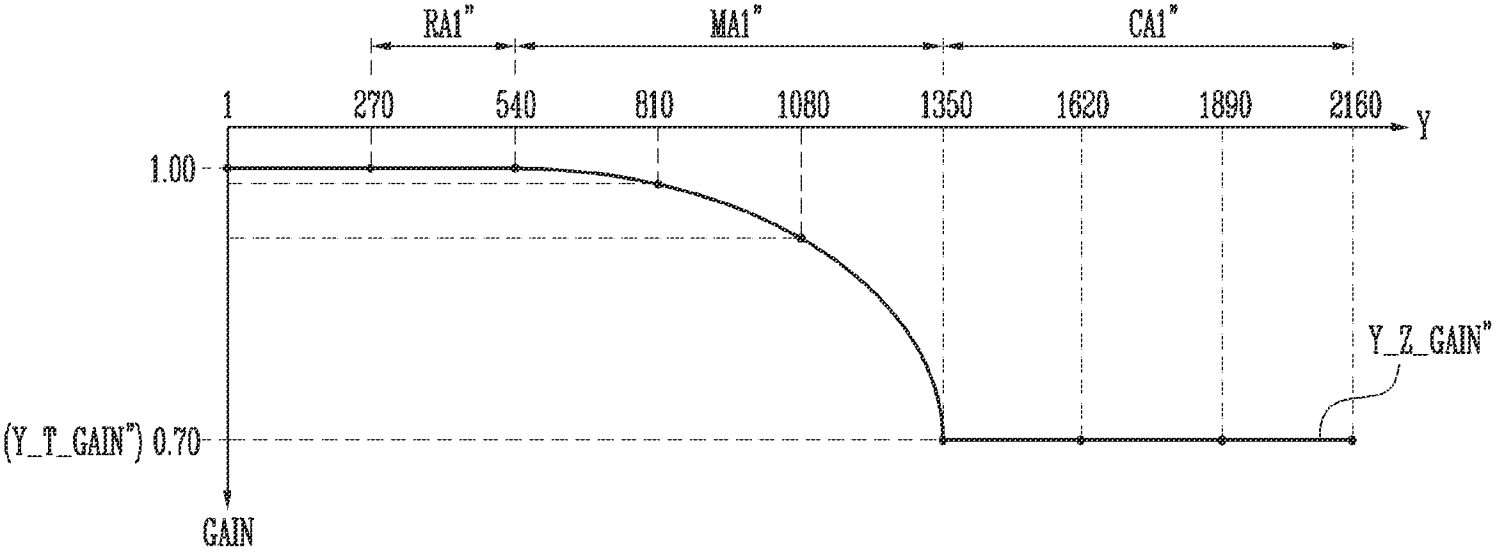

Accordingly, as illustrated in FIG. 8D, the gain controller (223 of FIG. 4) may select a value less than 1 (e.g., 0.70) as the second sub target gain value Y_T_GAIN" for the second direction DR2, and may decrease the gain value in the intermediate area MA1" as approaching the logo area CA1" from the reference area RA1". Here, the lowest gain value (that is, 0.70) in the intermediate area MA1" may be equal to the second sub target gain value Y_T_GAIN" corresponding to the logo area CA1". Meanwhile, all of the gain values for the areas, excluding the intermediate area MA1" and the logo area CA_1" from the display area DA including the reference area RA1", may have the value of 1.

In an embodiment, regardless of the location difference DD, the reference gain value R_GAIN along the second direction DR2 (that is, the second sub reference gain value Y_R_GAIN") and the second sub target gain value Y_T_GAIN" may decrease as the load value difference LD decreases.

For example, as illustrated in FIG. 8C, the value of 0.70 on the curve marked with the solid line may be selected as the second sub reference gain value Y_R_GAIN" and the second sub target gain value Y_T_GAIN" depending on the load value difference LD, regardless of the location difference DD.

Here, when the load value difference LD becomes smaller, the value of 0.55 on the curve marked with the dotted line may be selected as the second sub reference gain value Y_R_GAIN" and the second sub target gain value Y_T_GAIN". Accordingly, as the load value difference LD decreases, the gain value of the gain curve Z_GAIN corresponding to the logo area CA1" decreases based on the lower second sub target gain value Y_T_GAIN", whereby the luminance of the logo area CA1" may further decrease.

Because the second sub target gain value Y_T_GAIN" is selected depending on the magnitude of the load value difference LD regardless of the location difference LD, the decreasing rate of the gain value in the intermediate area MA1" may decrease as the location difference DD increases in response to the same second sub target gain value Y_T_GAIN" and as approaching the logo area CA1" from the reference area RA1", as illustrated in FIG. 8C.

Because the first location difference is less than the second location difference, the first sub gain curve X_Z_GAIN" may include the same gain values (e.g., the value of 1) regardless of the spatial location in the display area DA, as illustrated in FIG. 8B.

Accordingly, the gain curve Z_GAIN may include the same gain value regardless of the spatial locations along the first direction DR1, but may include different gain values depending on the spatial locations along the second direction DR2.

Figure 8E:
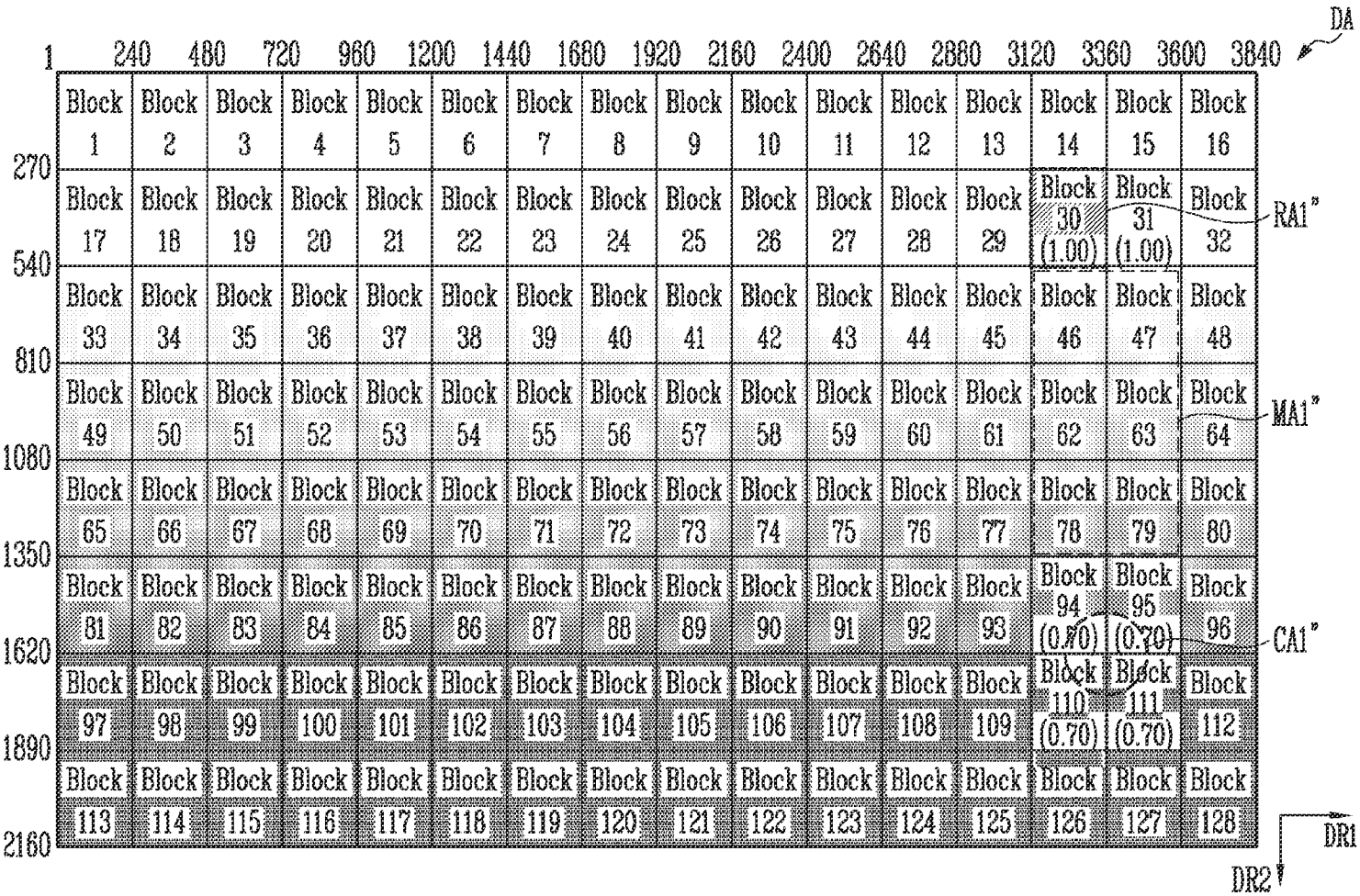

For example, in the case of the image displayed by applying the gain curve Z_GAIN to the input image data IDATA, the largest gain value (e.g., the value of 1.00) may be applied to the reference area RA1", the gain values applied to the intermediate area MA1" may gradually decrease as approaching the logo area CA1" from the reference area RA1", and the lowest gain value in the intermediate area MA1" and the gain value applied to the logo area CA1" (e.g., the value of 0.70 as the target gain value) may be smallest, as illustrated in FIG. 8E. Here, under the same grayscale condition, the luminance of the intermediate area MA1" may gradually decrease as approaching the logo area CA1" from the reference area RA1", and the lowest luminance in the intermediate area MA1" may be the same as the luminance of the logo area CA1".

The first sub gain curve X_Z_GAIN' of FIG. 7C and the second sub gain curve Y_Z_GAIN" of FIG. 8D may decrease nonlinearly in the intermediate area MA1' or MA1" as approaching the logo area CA1' or CA1" from the reference area RA1' or RA1", as illustrated in FIG. 7C and FIG. 8D. Accordingly, the gain curve Z_GAIN may also decrease nonlinearly in the intermediate area MA1' or MA1". However, the shape of the gain curve Z_GAIN is not limited thereto, and the gain curve Z_GAIN may decrease linearly.

As described above with reference to FIGS. 7A to 7E and FIGS. 8A to 8E, when the location difference DD between the compensation area (that is, the logo area CA1' or CA1") and the reference area RA1' or RA1" is equal to or greater than the reference distance RD or when the load value difference LD, which is the difference between the load value of the compensation area (that is, the logo area CA1' or CA1") and that of the reference area RA1' or RA1", is equal to or less than the reference load value RL, the zonal compensator (200 of FIG. 1) may differentially control the luminance of the intermediate area MA1' or MA1" between the compensation area (or the logo area CA1' or CA1") and the reference area RA1' or RA1" and the luminance of the compensation area (or the logo area CA1' or CA1") in consideration of the location difference DD and the load value difference LD. As described above, the zonal compensator 200 maintains the luminance of the area on which the eyes of a user are focused (that is, the reference area RA1' or RA1" having a large load value (the second load value L2) and the peripheral areas of the reference area RA1' or RA1") at a predetermined or higher level while performing zonal attenuation compensation for reducing power consumption of the display device 1000, thereby preventing visibility to the user from being reduced.

Figure 9:
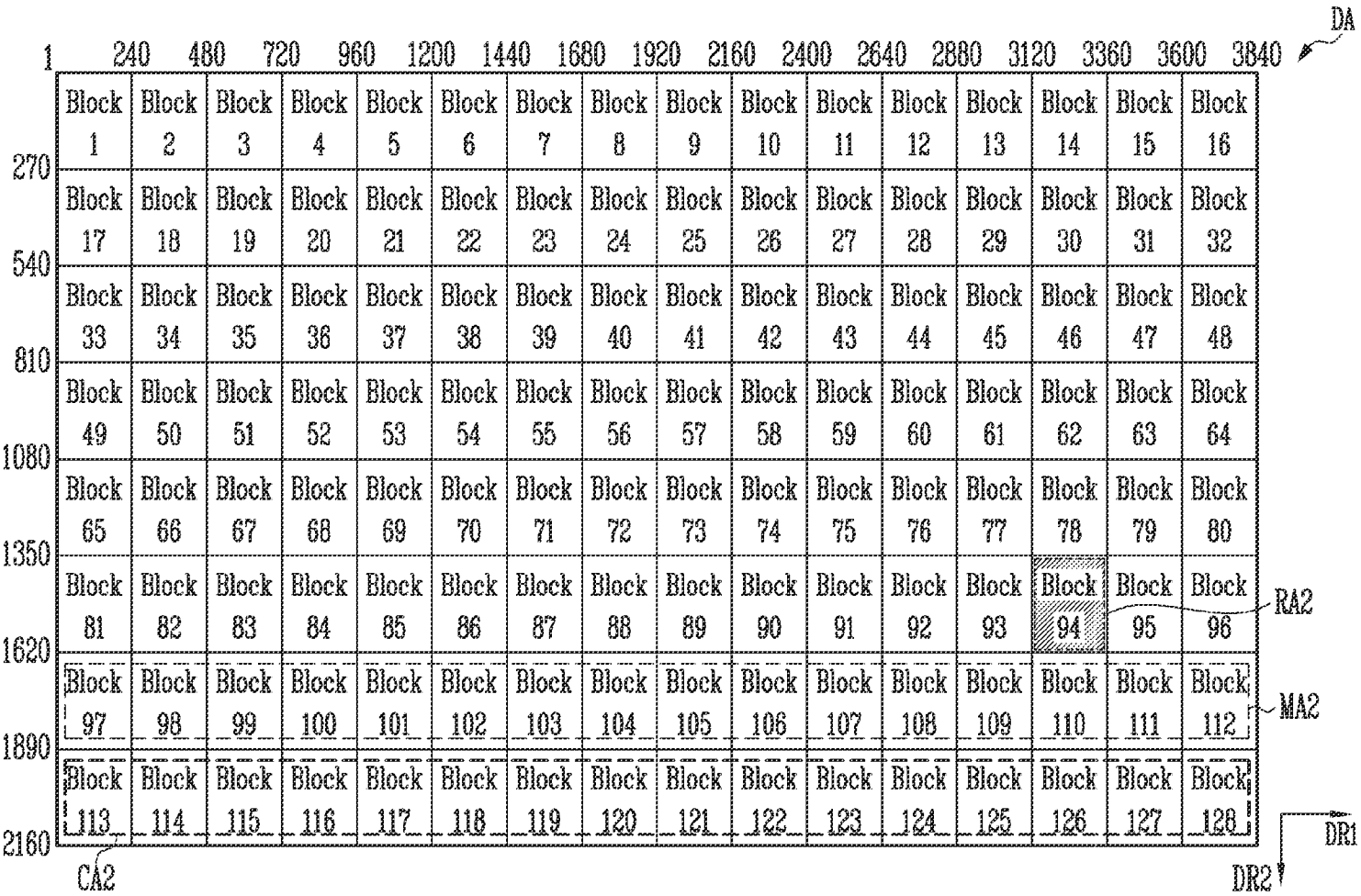
FIG. 9 and FIG. 10 are diagrams illustrating an example of the operation of the zonal compensator of FIG. 3.
Figure 10:
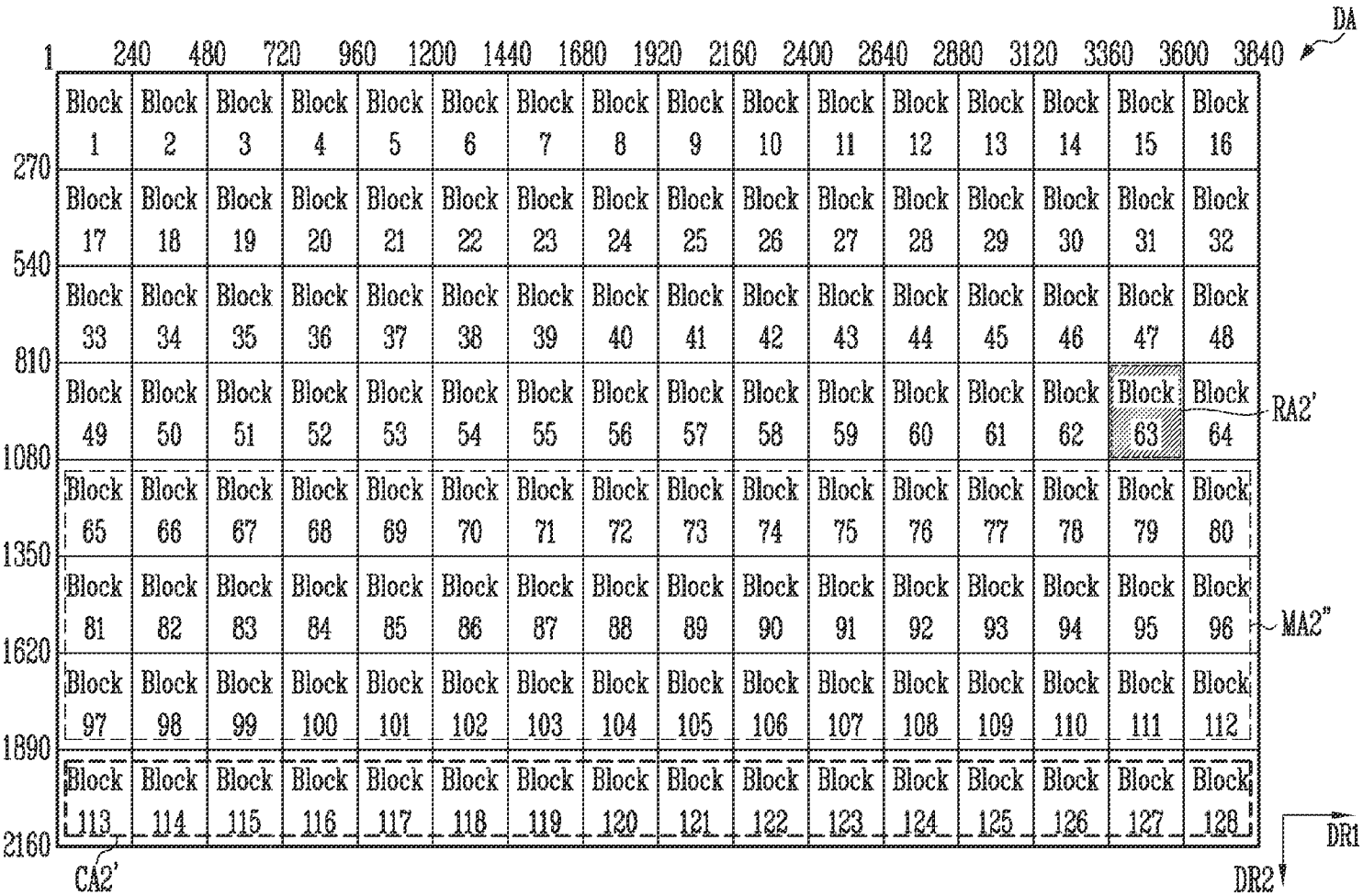

FIG. 9 and FIG. 10 are diagrams illustrating an example of the operation of the zonal compensator of FIG. 3.

In FIG. 9 and FIG. 10, a description will be made on the assumption that the display device 1000 displays a banner in the banner area CA2.

First, FIG. 9 may show the case in which the location difference DD between the banner area CA2 and the reference area RA2 is less than a preset reference distance RD and in which the load value difference LD, which is the difference between the load value of the banner area CA2 and that of the reference area RA2, is greater than a reference load value RL. In this case, the zonal compensator 200 may not apply zonal attenuation compensation based on the location difference DD and the load value difference LD.

In FIG. 9, the same reference numerals are used to designate the components that are the same as or similar to the components described with reference to FIGS. 6A to 6C, and a repeated description will be omitted.

Next, FIG. 10 may show the case in which the location difference DD between the banner area CA2' and the reference area RA2' is equal to or greater than the preset reference distance RD or the load value difference LD, which is the difference between the load value of the banner area CA2' and that of the reference area RA2', is equal to or less than the reference load value RL. In this case, the zonal compensator 200 may apply zonal attenuation compensation based on the location difference DD and the load value difference LD.

In FIG. 10, the same reference numerals are used to designate the components that are the same as or similar to the components described with reference to FIGS. 7A to 7E and FIGS. 8A to 8E, and a repeated description will be omitted.

Figure 11:
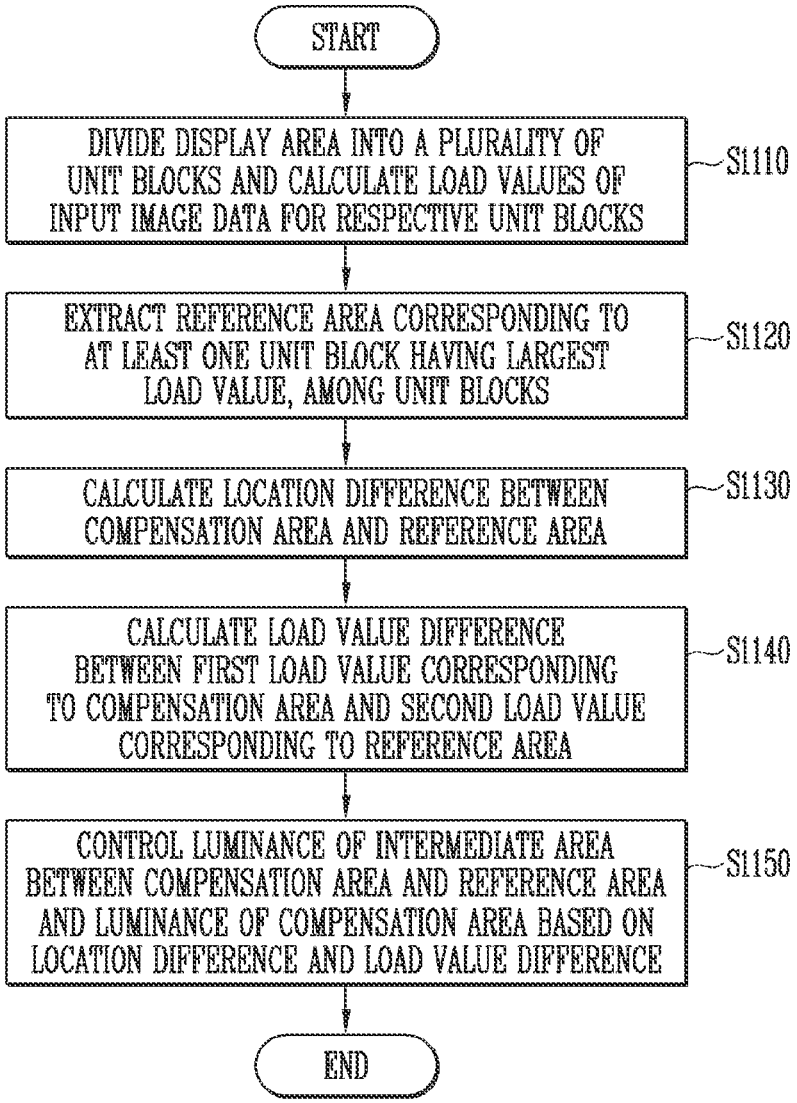
FIG. 11 is a flowchart illustrating a method of driving a display device according to embodiments of the present disclosure.

FIG. 11 is a flowchart illustrating a method of driving a display device according to embodiments of the present disclosure.

Referring to FIG. 1 and FIG. 11, the method of driving a display device, illustrated in FIG. 11, may be performed in the display device 1000 of FIG. 1. Because the operation in FIG. 11 is the same as the operation of the display device 1000 described with reference to FIGS. 1 to 10, a repeated description will be omitted.

First, in the driving method of FIG. 11, a display area (e.g., the display area DA of FIG. 2A) is divided into a plurality of unit blocks (e.g., the plurality of unit blocks Block1 to Block128 of FIG. 2A), and the load values of input image data may be calculated for the respective unit blocks at step S1110.

Then, in the driving method of FIG. 11, a reference area corresponding to at least one unit block having the largest load value among the unit blocks (e.g., the unit blocks Block1 to Block128 of FIG. 2A) may be extracted at step S1120.

Then, in the driving method of FIG. 11, the location difference between a compensation area and the reference area may be calculated at step S1130, and a load value difference, which is the difference between a first load value corresponding to the compensation area and a second load value corresponding to the reference area, may be calculated at step S1140. However, the order performing the step S1130 and the step S1140 is not limited to the order above. For example, the step S1140 may be performed before the step S1130 is performed or the step S1130 and the step S1140 may be performed at the same time.

Then, in the driving method of FIG. 11, the luminance of an intermediate area between the compensation area and the reference area, and the luminance of the compensation area may be controlled at step S1150 based on the location difference and the load value difference as disclosed in FIGS. 6A through 10 above.

Figure 12:
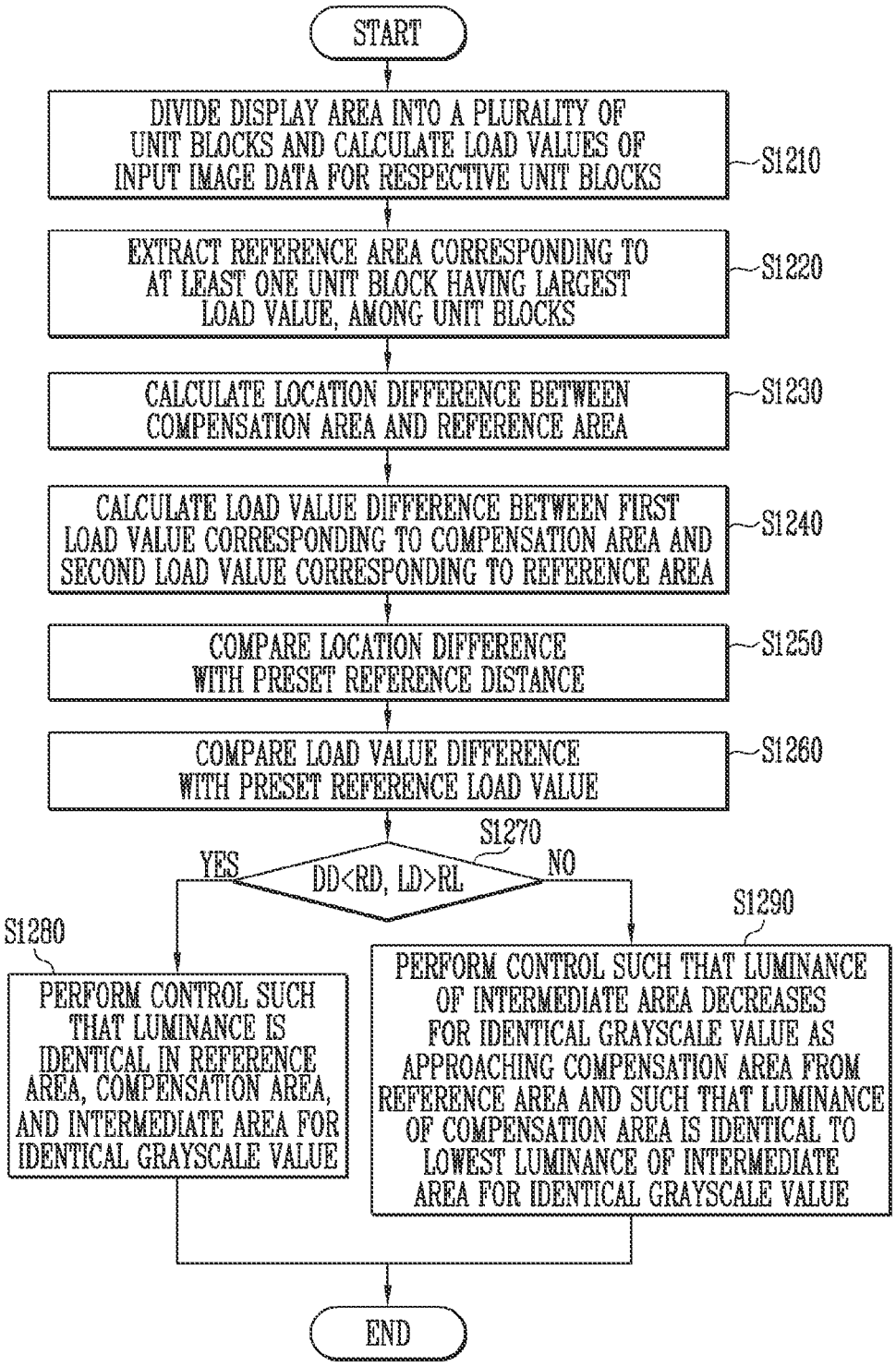
FIG. 12 is a flowchart illustrating an example of the method of driving a display device illustrated in FIG. 11.

FIG. 12 is a flowchart illustrating an example of the method of driving a display device, illustrated in FIG. 11.

Referring to FIG. 1 and FIG. 12, the method of driving a display device, illustrated in FIG. 12, may be performed in the display device 1000 of FIG. 1. Because the operation in FIG. 12 is the same as the operation of the display device 1000 described with reference to FIGS. 1 to 10, a repeated description will be omitted.

First, in the driving method of FIG. 12, a display area (e.g., the display area DA of FIG. 2A) is divided into a plurality of unit blocks (e.g., the plurality of unit blocks Block1 to Block128 of FIG. 2A), and the load values of input image data may be calculated for the respective unit blocks at step S1210.

Then, in the driving method of FIG. 12, a reference area corresponding to at least one unit block having the largest load value among the unit blocks (e.g., the unit blocks Block1 to Block128 of FIG. 2A) may be extracted at step S1220.

Then, in the driving method of FIG. 12, the location difference between a compensation area and the reference area may be calculated at step S1230, and a load value difference, which is the difference between a first load value corresponding to the compensation area and a second load value corresponding to the reference area, may be calculated at step S1240. However, the order performing the step S1230 and the step S1240 is not limited to the order above. For example, the step S1240 may be performed before the step S1230 is performed or the step S1230 and the step S1240 may be performed at the same time.

Then, in the driving method of FIG. 12, the location difference may be compared with a preset reference distance at step S1250, and the load value difference may be compared with a preset reference load value at step S1260. However, the order performing the step S1250 and the step S1260 is not limited to the order above. For example, the step S1260 may be performed before the step S1250 is performed or the step S1250 and the step S1260 may be performed at the same time.

In an embodiment, the driving method of FIG. 12 may be configured such that, when the location difference DD is less than the reference distance RD and when the load value difference LD is greater than the reference load value RL at step S1270, the luminance of the reference area, the luminance of the compensation area, and the luminance of the intermediate area therebetween may be controlled so as to be the same as each other for pixels having the same grayscale value at step S1280.

In an embodiment, the driving method of FIG. 12 may be configured such that, when the location difference DD is equal to or greater than the preset reference distance RD or when the load value difference LD is equal to or less than the preset reference load value RL at step S1270, control may be performed at step S1290 so as to decrease the luminance of the intermediate area between the reference area and the compensation area for pixels having the same grayscale value as approaching the compensation area from the reference area and so as to make the luminance of the compensation area to be the same as the lowest luminance of the intermediate area.

A display device according to the present disclosure may extract a reference area having the largest load value from unit blocks through a zonal compensator, and may control the luminance of an intermediate area between the reference area and a logo area (or a banner area) and the luminance of the logo area (or the banner area) based on the location difference between the reference area and the logo area (or the banner area) and the difference between the load values of the reference area and the logo area (or the banner area). Accordingly, while zonal attenuation compensation for reducing power consumption is performed, the area on which the eyes of a user are focused, such as the reference area, is prevented from being affected by zonal attenuation compensation, whereby visibility to the user may be prevented from being reduced.

The above detailed description exemplifies the present disclosure. Further, the above description merely illustrates and describes preferred embodiments of the present disclosure, and the present disclosure can be used under various combinations, changes, and environments. That is, modifications and changes may be made without departing from the scope of the concept of the present disclosure described in the present specification, equivalents thereof, and/or the scope of technology or knowledge to which the present disclosure pertains. Therefore, the detailed description of the present disclosure does not intend to limit the present disclosure to the disclosed embodiments. Further, it should be appreciated that the appended claims also include alternative embodiments.

What is claimed is:

1. A display device, comprising:

a display panel including pixels disposed in a display area;

a display panel driver configured to generate a data signal based on input image data and supply the data signal to the pixels; and a zonal compensator configured to control luminance of each of a first area of the display area and a third area of the display area based on a location difference between the first area and a second area of the display area, and a load value difference between the first area and the second area, wherein the zonal compensator is configured to extract load values of the input image data and the second area has the largest load value, and wherein, when the location difference is equal to or greater than a reference distance or when the load value difference is equal to or less than a reference load value, the zonal compensator decreases luminance of the third area for an identical grayscale value as approaching the first area from the second area, and controls the luminance of the first area so as to be identical to the lowest luminance of the third area.

2. The display device according to claim 1, wherein the first area displays a logo or a banner.

3. The display device according to claim 1, wherein the zonal compensator generates corrected image data by applying a gain curve to the input image data, wherein the display panel driver generates the data signal based on the corrected image data, and wherein the gain curve includes gain values corresponding to spatial locations in the display area.

4. The display device according to claim 3, wherein, as a gain value of the gain curve decreases, luminance of the corresponding spatial location in the display area decreases.

5. The display device according to claim 3, wherein the zonal compensator decreases the gain value of the gain curve corresponding to the first area as the location difference increases.

6. The display device according to claim 3, wherein the zonal compensator decreases a decreasing rate of the gain value of the gain curve as approaching the first area from the second area and as the location difference increases.

7. The display device according to claim 3, wherein the zonal compensator decreases the gain value of the gain curve corresponding to the first area as load value difference decreases.

8. The display device according to claim 3, wherein the gain curve decreases nonlinearly as approaching the first area from the second area.

9. The display device according to claim 3, wherein the gain curve decreases linearly as approaching the first area from the second area.

10. The display device according to claim 3, wherein the zonal compensator comprises:

an image analyzer configured to calculate a first location corresponding to the first area, a second location corresponding to the second area, a first load value corresponding to the first area, and a second load value corresponding to the second area based on the input image data;

a gain generator configured to calculate the location difference between the first location and the second location, to calculate the load value difference between the first load value and the second load value, and to generate the gain curve based on the location difference and the load value difference; and a data compensator configured to generate the corrected image data by applying the gain curve to the input image data.

11. The display device according to claim 10, wherein the image analyzer calculates the first load value and the second load value based on grayscale values of the input image data that respectively correspond to the first area and the second area.

12. The display device according to claim 10, wherein the image analyzer calculates the first load value and the second load value based on on-pixel ratios (OPR) that respectively correspond to the first area and the second area.

13. The display device according to claim 10, wherein the image analyzer calculates the first load value and the second load value based on data change amounts that respectively correspond to the first area and the second area.

14. The display device according to claim 10, wherein the image analyzer sets a location of a pixel within the first area that is closest to the second area as the first location and a location of a pixel within the second area that is closes to the first area as the second location.

15. The display device according to claim 1, wherein the zonal compensator generates corrected image data by applying a lookup table to the input image data, wherein the display panel driver generates the data signal based on the corrected image data, and wherein the lookup table includes gain values corresponding to spatial locations in the display area.

16. The display device according to claim 15, wherein, as a gain value of the lookup table decreases, luminance of the corresponding spatial location in the display area decreases.

* * * * *